US006658382B1

(12) United States Patent
Iwakami et al.

(10) Patent No.: US 6,658,382 B1
(45) Date of Patent: Dec. 2, 2003

(54) AUDIO SIGNAL CODING AND DECODING METHODS AND APPARATUS AND RECORDING MEDIA WITH PROGRAMS THEREFOR

(75) Inventors: Naoki Iwakami, Yokohama (JP); Takehiro Moriya, Tokyo (JP); Akio Jin, Tokyo (JP); Kazuaki Chikira, Hachioji (JP); Takeshi Mori, Tokorozawa (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 0 days.

(21) Appl. No.: 09/534,297

(22) Filed: Mar. 23, 2000

(30) Foreign Application Priority Data

Mar. 23, 1999 (JP) ..... 11-077061

(51) Int. Cl.[7] ..... G10L 19/02

(52) U.S. Cl. ..... 704/224; 704/205; 704/211; 704/267; 704/268; 704/269; 704/500

(58) Field of Search ..... 704/203, 205, 704/211, 241, 267, 268, 269, 500, 503, 224

(56) References Cited

U.S. PATENT DOCUMENTS 5,487,086 A * 1/1996 Bhaskar ..... 375/243
5,805,770 A * 9/1998 Tsutsui ..... 701/224
5,950,151 A * 9/1999 Bernardini ..... 704/200

FOREIGN PATENT DOCUMENTS

EP 0 673 014 3/1995
EP 0 713 295 3/1995
EP 0673014 A2 * 9/1995 ..... G10L/9/14
EP 0713295 A1 * 5/1996 ..... H03M/7/30
WO WO 94/28633 12/1994

OTHER PUBLICATIONS

Iwakami, N., "Improvement of audio transform coding using a foreground–background categorization method," NTT Laboratories, Oct. 9, 1999, pp. 317–318.

Iwakami, N., et al., Transform–Domain Weighted Interleave Vector Quantization (Twin VQ), NTT Human Interface Laboratories, Speech and Acoustics laboratory, Musashi-no–shi, Tokyo, Japan, Nov. 8–11, 1999, pp. 1–5, and three sheets drawings.

* cited by examiner

*Primary Examiner*—Richemond Dorvil
*Assistant Examiner*—Kinari Patel
(74) *Attorney, Agent, or Firm*—Connolly Bove Lodge & Hutz LLP

(57) ABSTRACT

An input signal is time-frequency transformed, then the frequency-domain coefficients are divided into coefficient segments of about 100 Hz width to generate a sequence of coefficient segments, and the sequence of coefficient segments is split into subbands each consisting of plural coefficient segments. A threshold value is determined based on the intensity of each coefficient segment in each subband. The intensity of each coefficient segment is compared with the threshold value, and the coefficient segments are classified into low- and high-intensity groups. The coefficient segments are quantized for each group, or they are flattened respectively and then quantized through recombination.

46 Claims, 17 Drawing Sheets

AUDIO SIGNAL CODING AND DECODING METHODS AND APPARATUS AND RECORDING MEDIA WITH PROGRAMS THEREFOR

BACKGROUND OF THE INVENTION

The present invention relates to methods and apparatus for encoding an audio signal into a digital code with high efficiency and for decoding the digital code into the audio signal, which can be employed for recording and reproduction of audio signals and their transmission and broadcasting over a communication channel.

A conventional high-efficiency audio-coding scheme is such a transform coding method as depicted in FIG. 1. With this method, an audio signal input as a sequence of signal samples is transformed into frequency-domain coefficients in a time-frequency transformation part 11 upon each input of a fixed number of samples and then encoded and the encoded frequency-domain coefficients are preprocessed in a preprocessing part 2 and quantized in a quantization part 3. A typical example of this scheme is TWINVQ (Transform-domain Weighted Interleave Vector Quantization).

The TWINVQ scheme uses weighted interleave vector quantization at the final stage of the quantization part 3. The vector quantization features two-stage flattening of coefficients in the preprocessing part 2 since the quantization efficiency increases as the distribution of input coefficient values becomes more even. In the first stage, the frequency-domain coefficients are normalized by the LPC spectrum to thereby roughly flatten their total variations. In the second stage, frequency-domain coefficients are further normalized for each of subbands having the same bandwidth on the Bark scale, by which they are flattened more finely than in the first stage. The Bark scale is a kind of frequency scale.

The Bark scale has a feature that frequencies at equally spaced points provide pitches of sound nearly equally spaced apart in terms of the human auditory sense. The subbands of the same bandwidth on the Bark scale are approximately equal in width perceptually, but on a linear scale their bandwidth increases with an increase in frequency as shown in FIG. 2. Accordingly, when the frequency-domain coefficients are split into subbands having similar bandwidth on the Bark scale, the higher the frequency of the subband, the more it contains coefficients.

The second-stage flattening on the Bark scale is intended to effectively allocate a limited amount of information, taking the human auditory sense into account. The flattening operation by normalization for each subband on the Bark scale is based on the expectation that the coefficients in the subbands are steady, but since the subbands at higher frequencies contain more coefficients, the situation occasionally arises where the coefficients are not steady in the subbands as depicted in FIG. 2. This incurs impairment of the efficiency of vector quantization, leading to the degradation of sound quality of decoded audio signals. Such a problem is likely to occur especially when the input audio signal contains a lot of tone components in the high-frequency range.

By the way, the TWINVQ scheme is described in detail in N. Iwakami, et al., "Transformed Domain Interleave Vector Quantization (TwinVQ)," preprint of the 101st Audio Engineering Society Convention, 4377, (1996).

In the audio-coding of FIG. 1, the quantization may also be scalar quantization using adaptive bit allocation. Such a coding method splits the frequency-domain coefficients into subbands and conducts optimum bit allocation for each subband. The subbands may sometimes be divided so that they have the same bandwidth on the Bark scale with a view to achieving a better match to the human auditory sense. In this instance, however, the coefficients in the subbands at the higher frequencies are often unsteady as is the case with the TWINVQ scheme, leading to impairment of the quantization efficiency.

As a solution to such a problem, there is proposed in Japanese Patent Application Laid-Open Gazette No. 7-336232 a coding method that transforms the input signal to a frequency-domain signal and adaptively changes with the shape of the spectral envelope the bandwidth of each subband in which the frequency-domain coefficients are flattened (normalized). This method makes narrow the bandwidths of subbands containing tone components and wide the bandwidths of other subbands, thereby reducing the number of subbands and hence increasing the coding efficiency accordingly. With this method, however, when tone components are sparse, narrow bandwidths are applied to flat portions near the tone components, sometimes impairing the coding efficiency. Further, normalization information needs to be encoded and sent for each component; therefore, if many tone components are scattered, the amount of normalization information to be encoded increases accordingly.

With a view to increasing the coding efficiency, there is proposed in Japanese Patent Application Laid-Open Gazette No. 7-168593 a scheme of encoding the tone component and others separately of each other. With this scheme, since the spectrum of each maximal value and adjoining spectra are normalized and encoded as a tone component signal of one group, information about the position of the spectrum o the maximal value and the group size needs to be encoded and sent. On this account, when many tone components are present, it is necessary to encode many pieces of information about the positions of the spectra of maximal values and the group sizes—this is likely to constitute an obstacle to increasing the coding efficiency.

Japanese Patent Application Laid-Open Gazette No. 7-248145 describes a scheme which separates pitch components formed by equally spaced tone components and encoding them individually. The position information of the pitch components is given by the fundamental frequency of the pitch, and hence the amount of information involved is small; however, in the case of a metallic sound or the like of a non-integral harmonic structure, the tone components cannot accurately be separated.

SUMMARY OF THE INVENTION

It is an object of the present invention to provide a coding method which permits highly efficient transform coding of the input audio signal having many tone components in the high-frequency range, a decoding method for such a coded signal, apparatus using the coding and decoding methods, and recording media having recorded thereon the methods as computer-executable programs.

According to an aspect of the present invention, there is provided an audio signal coding method for coding input audio signal samples, the method comprising the steps of:

(a) time-frequency transforming every fixed number of input audio signal samples into frequency-domain coefficients;

(b) dividing said frequency-domain coefficients into coefficient segments each consisting of one or more coefficients to generate a sequence of coefficient segments;

(c) calculating the intensity of each coefficient segment in said sequence of coefficient segments;

(d) classifying the sequence of coefficient segments into either one of at least two groups according to the intensities of said coefficient segments to generate at least two sequences of coefficient segments, and encoding and outputting classification information as a classification information code; and (e) encoding said at least two sequences of coefficient segments and outputting them as coefficient codes.

According to another aspect of the present invention, there is provided a decoding method for decoding input digital codes into audio signal samples and outputting them, the method comprising the steps of:

(a) decoding said input digital codes into plural sequences of coefficient segments;

(b) decoding said input digital codes to obtain classification information of coefficient segments, combining said plural sequences of coefficient segments based on said classification information to reconstruct original frequency-domain coefficients formed by a single contiguous sequence of coefficient segments; and (c) transforming said frequency-domain coefficients into the time domain and outputting the resulting audio signal samples as an audio signal.

According to another aspect of the present invention, there is provided a decoding method comprises the steps of:

(a) decoding said input digital codes into coefficient segments each consisting of plural frequency-domain coefficients;

(b) decoding said input digital codes to obtain classification information of said coefficient segments and classifying said coefficient segments into plural sequences of coefficient segments based on said classification information;

(c) decoding said input digital codes to obtain normalization information of said coefficient segments and inverse-normalizing plural sequences of coefficient segments based on said normalization information;

(d) rearranging said inverse-normalized plural sequences of coefficient segments into the original single sequence to reconstruct original frequency-domain coefficients: and (e) transforming said frequency-domain coefficients into the time domain and outputting the resulting audio signal samples as an audio signal.

According to another aspect of the present invention, there is provided a coding apparatus which encodes input audio signal samples into output digital codes, the apparatus comprising:

a time-frequency transformation part for time-frequency transforming every fixed number of input audio signal samples into frequency-domain coefficients;

a coefficient segment generating part for dividing said frequency-domain coefficients from said time-frequency transformation part into segments each consisting of a contiguous sequence of coefficients;

a segmental intensity calculating part for calculating the intensity of each coefficient segment from said coefficient segment generating part;

a coefficient segment classifying part for dividing said coefficient segments into at least two groups according to the relative magnitude of said segmental intensity calculated in said segmental intensity calculating part, then classifying said segments generated in said coefficient segment generating part into at least two sequences based on information about said grouping, and encoding and outputting classification information as a digital code; and a quantization part for encoding each of said coefficients classified into said at least two sequences and outputting said encoded coefficients as said digital codes.

According to another aspect of the present invention, there is provided a coding apparatus which comprises:

a time-frequency transformation part for time-frequency transforming every fixed number of input audio signal samples into frequency-domain coefficients;

a coefficient segment generating part for dividing said frequency-domain coefficients from said time-frequency transformation part into segments each consisting of a contiguous sequence of coefficients;

a segmental intensity calculating part for calculating the intensity of each coefficient segment from said coefficient segment generating part;

a coefficient segment classifying part for dividing said coefficient segments into at least two groups according to the relative magnitude of said segmental intensity calculated in said segmental intensity calculating part, then classifying said segments generated in said coefficient segment generating part into at least two sequences based on information about said grouping, and encoding and outputting classification information as a digital code;

a flattening part for normalizing the intensity of each of said coefficient segments classified into at least two sequences in said coefficient segment classifying part, coding normalization information, and outputting said coded information as a digital code;

a coefficient combining part for recombining said at least two sequences of intensity-normalized coefficient segments into the original single sequence of coefficient segments through utilization of said grouping information; and a quantization part for quantizing said recombined coefficient segments and outputting the quantized values as said digital codes.

According to another aspect of the present invention, there is provided a decoding apparatus which decodes input digital codes into audio signal samples, the apparatus comprising:

an inverse-quantization part for decoding said input digital codes into plural sequences of coefficient segments;

a coefficient combining part for decoding said input digital codes to obtain classification information of said coefficient segments, and combining said plural sequences of coefficient segments based on said classification information to reconstruct a single sequence of frequency-domain coefficients sequentially arranged; and a frequency-time transformation part for frequency-time transforming the reconstructed frequency-domain coefficients into the time domain and outputting the resulting audio signal samples as an audio signal.

According to still another aspect of the present invention, there is provided a decoding apparatus which comprises:

an inverse-quantization part for decoding said input digital codes into coefficient segments;

a coefficient segment classifying part for decoding said input digital codes to obtain classification information of said coefficient segments, and classifying said coefficient segments into plural sequences based on said classification information;

an inverse-flattening part for decoding said input digital codes to obtain normalization information of said coefficient segments classified into said plural sequences, and inverse-normalizing said plural sequences of coefficient segments based on said the normalization information;

a coefficient combining part for combining said inverse-normalized plural sequences of coefficient segments into a single sequence of coefficient segments sequentially arranged based on said classification information to reconstruct said frequency-domain coefficients; and a frequency-time transformation part for frequency-time transforming said frequency-domain coefficient into the time domain and outputting the resulting audio signal samples as an audio signal.

DETAILED DESCRIPTION OF THE PREFERRED EMBODIMENTS

Figure 1:
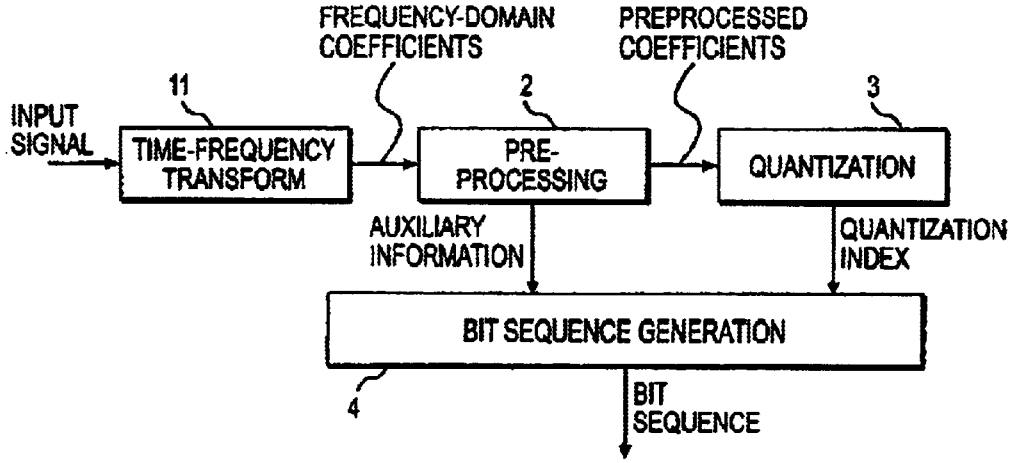
FIG. 1 PRIOR ART
FIG. 1 is a block diagram depicting a general form of a transform coding method.
Figure 2:
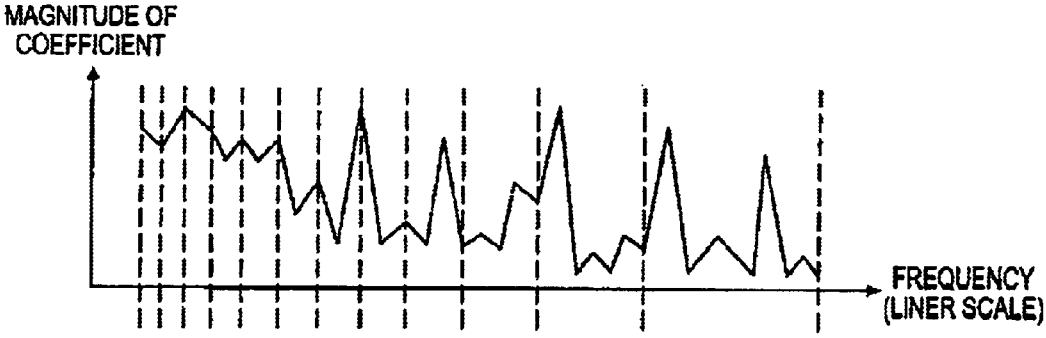
FIG. 2 PRIOR ART
FIG. 2 is a waveform diagram showing an example of the amplitude shape of frequency-domain coefficients.
Figure 3:
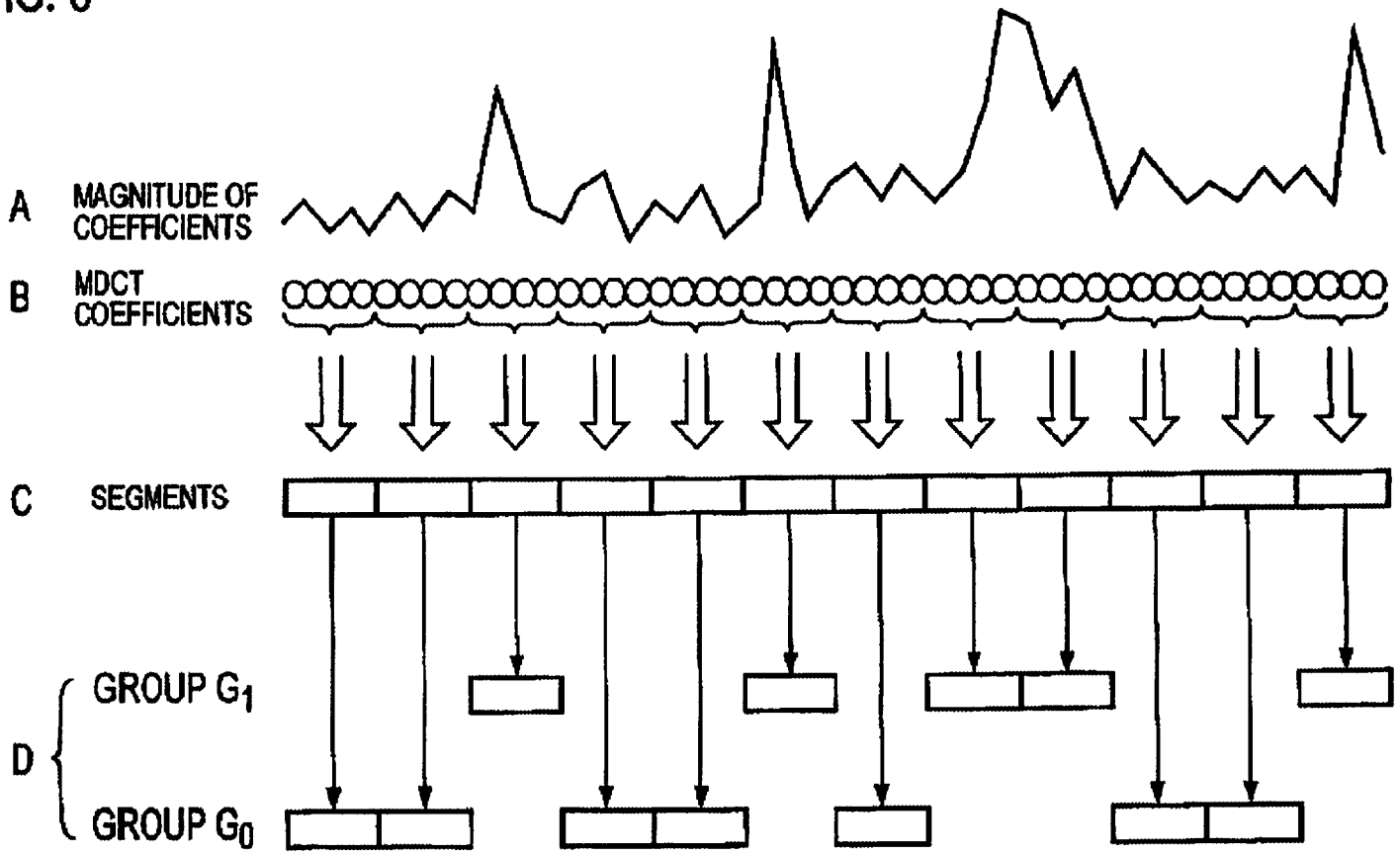
FIG. 3 is a diagram for explaining the principles of the present invention.

In the present invention, the input signal is transformed into a contiguous sequence of frequency-domain coefficients, which is divided into coefficient segments for each band of about 100 Hz, and the coefficient segments are classified into at least two groups according to their intensity, for example, high- and low-level groups. For instance, when the frequency-domain coefficients vary in magnitude as depicted in FIG. 3, Row A, adjoining frequency-domain coefficients or coefficients of modified discrete cosine transform (MDCI shown in FIG. 3 Row B, are put together into coefficient segments as depicted in FIG. 3, Row C and these coefficient segments are classified into groups $G_0$ and $G_1$ according to their intensity as shown in FIG. 3, Row D. The high- and low-intensity groups $G_0$ and $G_1$ are processed independently of each other. One possible method for the independent processing after classification is to quantize the coefficients of the two groups $G_0$ and $G_1$ separately; an alternative is to vector quantize the coefficients of the two groups $G_0$ and $G_1$ after flattening them independently of each other.

Since the coefficient segments belonging to each of the two groups after classification are based on the same sound source, the intensity variation in each group is small. Accordingly, it is possible to achieve highly efficient quantization while keeping perceptually good allocation of information over equal bandwidths, if the independent processing after classification is carried out for each of equally spaced sub-bands on the Bark scale. The coefficient segments may also be grouped into three or more.

As described above, according to the present invention, the coefficient segments are classified into plural groups, then flattened for each group and encoded, while at the same time classification information is encoded. Since this classification information is easy of compression as compared with the position information needed in the method set forth in the afore-mentioned Japanese Patent Application Laid-Open Gazette No. 7-168593, the amount of information involved can be suppressed; hence, the classification information can be encoded with high efficiency.

FIRST EMBODIMENT

Figure 4:
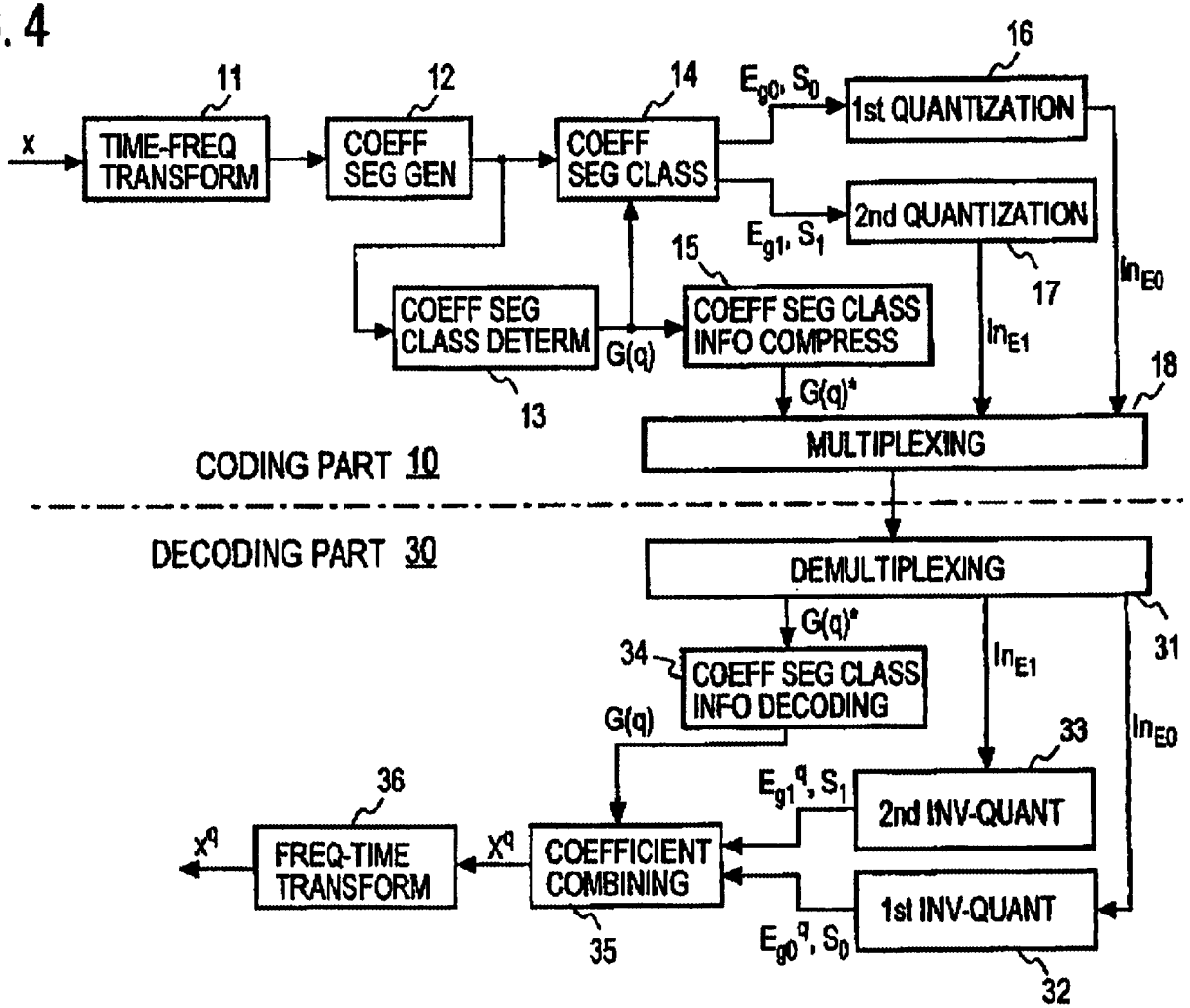
FIG. 4 is a block diagram depicting the functional configuration of a first embodiment of the present invention.

FIG. 4 illustrates in block form a first embodiment of the present invention.

Processing parts 11 through 18 constitute a coding part 10, which is supplied with an audio signal x as a sample sequence and outputs a coded bit sequence C. Processing parts 31 through 36 constitute a decoding part 30, which is supplied with the coded bit sequence C and outputs the audio signal x as a sample sequence.

Time-Frequency Transform Part 11

The input audio signal x is provided as a sample sequence to a time-frequency transformation part 11, which performs time-frequency transform upon each input of a fixed number N of samples to obtain N frequency-domain coefficients. This time-frequency transform can be done by discrete cosine transform (DCT) or modified discrete cosine transform (MDCT). With the modified discrete cosine transform scheme, every N input audio samples and the immediately preceding N samples, that is, a total of 2×N audio samples, are transformed into N frequency-domain coefficients. The input samples may also be multiplied by a Hamming or Hanning window function immediately prior to the time-frequency transform processing. In particular, in the case of using the modified discrete cosine transform scheme, the input samples x may preferably be multiplied by the window W expressed by the following equation (1):

$$W(i)=0.5\{1-\cos[2\pi(0.5+i)/N]\},\ i=0,1,\ldots,N-1 \tag{1}$$

Mathematically expressed, the above processing modified discrete cosine transform is given as follows:

$$X(k)=\sum_{i=0}^{2N-1} W(i)x(i)\cos(\pi/N)[i+(N+1)/2](k+1/2) \tag{2}$$

where i is the input sample number, k is the number representing frequency and x represents the input samples.

Coefficient Segment Generating Part 12

The frequency-domain coefficients obtained in the time-frequency transformation part 11 are input to a coefficient segment generating part 12, wherein they are grouped into coefficient segments in steps of M. As a result, each coefficient segment E is formed as expressed by the following equation:

$$E(q,m)=X(q\cdot M+m),\ q=0,1,\ldots,Q-1;\ m=0,1,\ldots,M-1 \text{ for each } q \tag{3}$$

where q is the number representing the coefficient segment, m the number representing each coefficient in the coefficient segment and Q the number of coefficient segments. The magnitude M of the coefficient segment may be set to an arbitrary integral value equal to or greater than 1, but it is effective in increasing coding efficiency to set the magnitude M of the coefficient segment such that its frequency width becomes, for example, approximately 100 Hz. For instance, when the input signal sampling frequency is 48 kHz, the magnitude M of the coefficient segment is set to around 8. While the value M is described here to be common to all the coefficient segments, it may be set individually for each segment.

The coefficient segments thus created in the coefficient segment generating part 12 are fed to a coefficient segment classification determining part 13 and a coefficient segment classifying part 14.

Coefficient Segment Classification Determining Part 13

Figure 5:
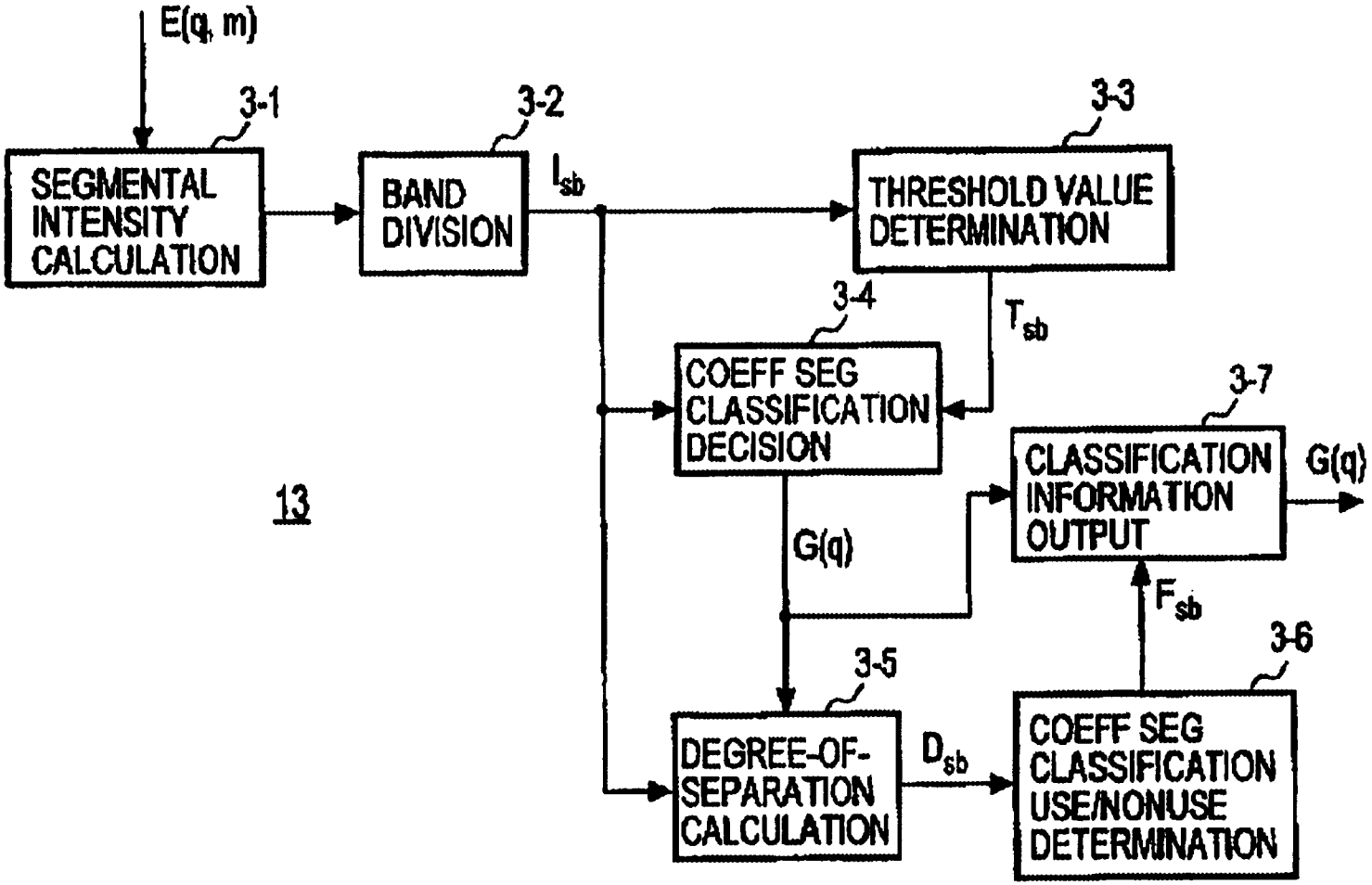
FIG. 5 is a block diagram depicting a detailed functional configuration of a coefficient segment classification determining part 13 in first, second and third embodiments of the present invention.

FIG. 5 illustrates in block form a detailed configuration of the coefficient segment classification determining part 13. The coefficient segment classification determining part 13 is supplied with the coefficient segments from the coefficient segment generating part 12 and outputs their classification information. That is, the input coefficient segments are fed to a coefficient-segmental intensity calculating part 3-1, which calculates the intensity I of each segment as follows:

$$I(q)=\left(\sum_{m=0}^{M-1} E(q,m)^2\right)^{1/2},\qquad q=0,1,\ldots,Q-1 \tag{4}$$

A sequence of coefficient-segmental intensity I is split by a band splitting part 3-2 into subbands. The thus split segmental intensity is expressed by $I_{sb}(i_{sb}, q_{sb})$ where $i_{sb}$ denotes the number of each subband and $q_{sb}$ the segment number in the subband. The number of coefficient segments in one subband is an arbitrary number equal to or greater than 2, which is given by $Q_{sb}(i_{sb})$. The relationship between I(q) and $I_{sb}$ is expressed by the following equation:

$$I_{sb}(i_{sb}, q_{sb})=I(q) \tag{5}$$

And, $i_{sb}$, $q_{sb}$ and q bear such relationships as given by the following equation:

$$q=q_{sb}+\sum_{j=0}^{i_{sb}} Q_{sb}(j) \tag{6}$$

The segmental intensity thus split into subbands by the band splitting part 3-2 is provided to a threshold determining part 3-3, segment classification decision part 3-4 and a degree-of-separation calculating part 3-5.

In the threshold determining part 3-3, maximum and minimum values of the segmental intensity from the band splitting part 3-2 are calculated for each subband, and the calculated values are used to determine, by the following equation, a threshold value T for classifying the segments.

$$T_{sb}(i_{ab})=\alpha I_{sb}(i_{sb}, q_{max})+(1-\alpha)I_{sb}(i_{sb}, q_{min}) \tag{7}$$

where $q_{min}$ is the number of the coefficient segment of the minimum value of the segmental intensity $I_{sb}$, $q_{max}$ is the number of the coefficient segment of the maximum value of the segmental intensity $I_{sb}$ and α is a constant satisfying $1 \geqq \alpha > 0$. The value of the constant α is set at about 0.4. The thus determined threshold value $T_{sb}$ is provided to the segment classification decision part 3-4.

The segment classification decision part 3-4 compares the segmental intensity $I_{sb}$ from the band splitting part 3-2 with the threshold value $T_{sb}$ from the segment classification determining part 3-3 to decide the classification of the coefficient segment and the classification information G is determined by the following equation for q=0,1, . . . ,Q−1.

$$G(q)=0 \text{ for } I_{sb}(i_{sb}, q_{sb}) \leqq T_{sb}(i_{sb})=1 \text{ for } I_{sb}(i_{sb}, q_{sb})>T_{sb}(i_{sb}) \tag{8}$$

The segment classification information G(q) thus determined is provided to the degree-of-separation calculating part 3-5 and a classification information output part 3-7.

The degree-of-separation calculating part 3-5 uses the segmental intensity $I_{sb}$ from the band splitting part 3-2 and the segment classification information G(q) from the segment classification decision part 3-4 to divide the segmental intensity $I_{sb}$ into two groups G(q)=0 and G(q)=1, and calculates the degree of separation from the intensity values of the two groups. The calculation of the degree of separation is preceded by the calculation of the intensity values of the two groups. The intensity $I_{G0}$ of the group G(q)=0 is computed as expressed by the following equation:

$$I_{G0}(i_{sb}) = \sum_{q_{sb}=0}^{Q_{sb}-1} [1 - G(q)] \cdot I_{sb}(i_{sb}, q_{sb}) \quad (9)$$

The intensity $I_{G1}$ of the group G(q)=1 is calculated as expressed by the following equation:

$$I_{G1}(i_{sb}) = \sum_{q_{sb}=0}^{Q_{sb}-1} G(q) \cdot I_{sb}(i_{sb}, q_{sb}) \quad (10)$$

The degree of separation $D_{sb}$ is determined from $I_{G0}$ and $I_{G1}$ as follows:

$$D_{sb}(i_{sb}) = I_{G1}(i_{sb}) / I_{G0}(i_{sb}) \quad (11)$$

The degree of separation $D_{sb}(i_{sb})$ thus determined for each subband $i_{sb}$ is provided to a segment classification use/nonuse determining part 3-6.

Based on the degree of separation determined in the degree-of-separation calculating part 3-5, the segment classification use/nonuse determining part 3-6 determines for each subband whether to use the segment classification. When the degree of separation $D_{sb}$ is in excess of a threshold value $D_t$, a segment classification use flag $F_{sb}(i_{sb})$ is set at 1. When the degree of separation does not exceed the threshold value, the flag $F_{sb}(i_{sb})$ is set at 0. The segment classification use flag $F_{sb}$ determined in the part 3-6 is provided to the classification information output part 3-7.

The classification information output part 3-7 redetermines the classification information G(q) from the segment classification decision part 3-4 for each subband based on the segment classification use flag $F_{sb}(i_{sb})$ received from the segment classification use/nonuse determining part 3-6. When the value of the flag $F_{sb}(i_{sb})$ is 0, all values of classification information G(q) of the coefficient segments belonging to the $i_{sb}$-th subband are set to 0s. When the value of the flag $F_{sb}(i_{sb})$ is 1, the classification information of the coefficient segments belonging to the $i_{sb}$-th subband are held unchanged. Incidentally, the redetermination of the information G(q) through the use of the flag $F_{sb}$ is not necessarily required, but the redetermination using the flag $F_{sb}$ permits reduction to zero of the information G(q) of a coefficient segment of small variations in the coefficient magnitude in the subband, providing increased efficiency in the encoding of the classification information G(q) that is carried out afterward.

The classification information G(q) thus redetermined in the classification information output part 3-7 is output from the coefficient segment classification determining part 13, and this information is fed to the coefficient segment classifying part 14 and the coefficient segment classification information compressing part 15.

Coefficient Segment Classifying Part 14

The coefficient segment classifying part 14 is supplied with the coefficient segments generated in the coefficient segment generating part 12 an the coefficient segment classification information G(q) determined in the coefficient segment classification determining part 13, and classifies all the coefficient segments into a group $E_{g0}$ of G(q)=0 and a group $E_{g1}$ of G(q)=1.

Assume that the coefficient segment classifying part 14 has a memory (not shown) for storing sizes $S_0$ and $S_1$ of the groups $E_{g0}$ and $E_{g1}$ and a memory (not shown) that serves as a counter for counting the segment number q.

Figure 6:
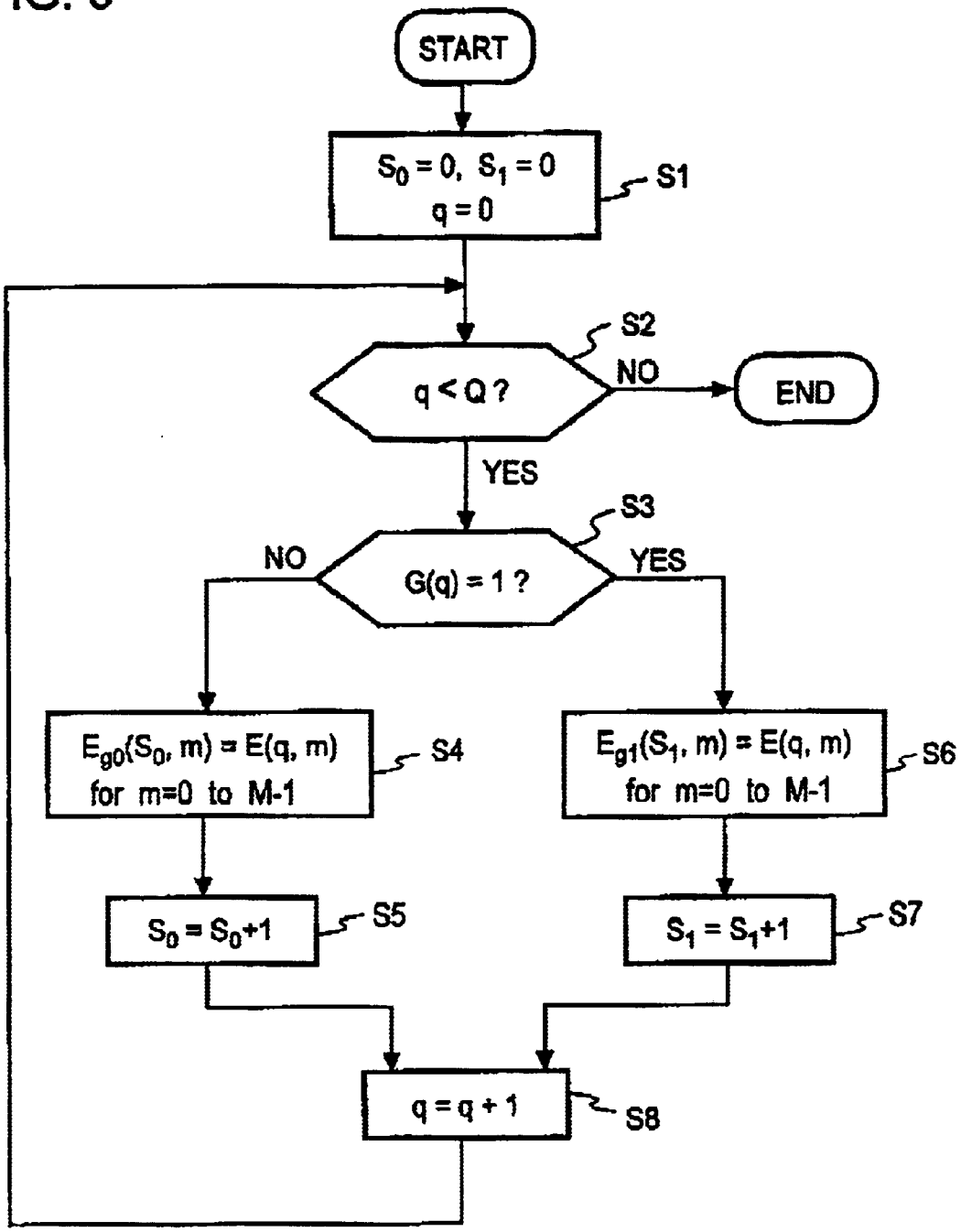
FIG. 6 is a process flow diagram of a coefficient segment classifying part 14 in the first, second and third embodiments of the present invention.

FIG. 6 is a process flow diagram of the coefficient segment classifying part 14.

The process by the coefficient segment classifying part 14 starts with clearing all the memories $S_0$, $S_1$ and q to zero.

Next, the segment number q in the memory q is compared with the number A of coefficient segments E(q, m), and if the former is smaller than the latter, the process goes to step S3; if not, $E_{g0}(S_0, m)$ and $E_{g1}(S_1, m)$ are output as the groups $E_{g0}$ and $E_{g1}$ together with their sizes $S_0$ and $S_1$, respectively, and the process ends (Step S2).

In step S3 it is determined whether the value of the classification information of the coefficient segment is 1, and if so, then the process goes to step S6, and if not, to step S4.

In step S4 the segment E(q, m) indicated by the memory counter q is added to the segment group $E_{g0}$ as expressed by the following equation:

$$E_{g0}(S_0, m) = E(q, m),\ m = 0, 1, \ldots, M-1$$

In step S5 the group size $S_0$ in the memory is incremented by one and the process goes to step S8.

In step S6 the segment E(q, m) indicated by the memory counter q is added to the segment group $E_{g1}$ as expressed by the following equation:

$$E_{g1}(S_1, m) = E(q, m),\ m = 0, 1, \ldots, M-1$$

In step S7 the group size $S_1$ in the memory is incremented by one and the process goes to step S8.

In step S8 the memory counter for the segment number q is incremented by one and the process goes to step S2.

The segment groups $E_{g0}$ and $E_{g1}$ classified in the coefficient classifying part 14 and their sizes $S_0$, $S_1$ as described above are provided to the first and second quantization parts 16 and 17, respectively.

Coefficient Segment Classification Information Compressing Part 15

The coefficient segment classification information compressing part 14 compresses a sequence of coefficient segment classification information G(q), where q=0,1, . . . ,Q−1, determined in the coefficient segment classification determining part 13 and provides the compressed coefficient segment classification information G(q)* to the multiplexing part 18.

Since the coefficient segment classification information G(q) normally takes the value 0 or 1 with a higher probability, any reversible compression coding schemes utilizing such a property can be used, but such entropy coding schemes as Huffman coding and arithmetic coding are particularly efficient. Besides, run length coding is also effective in compressing the classification information G(q).

Figure 7:
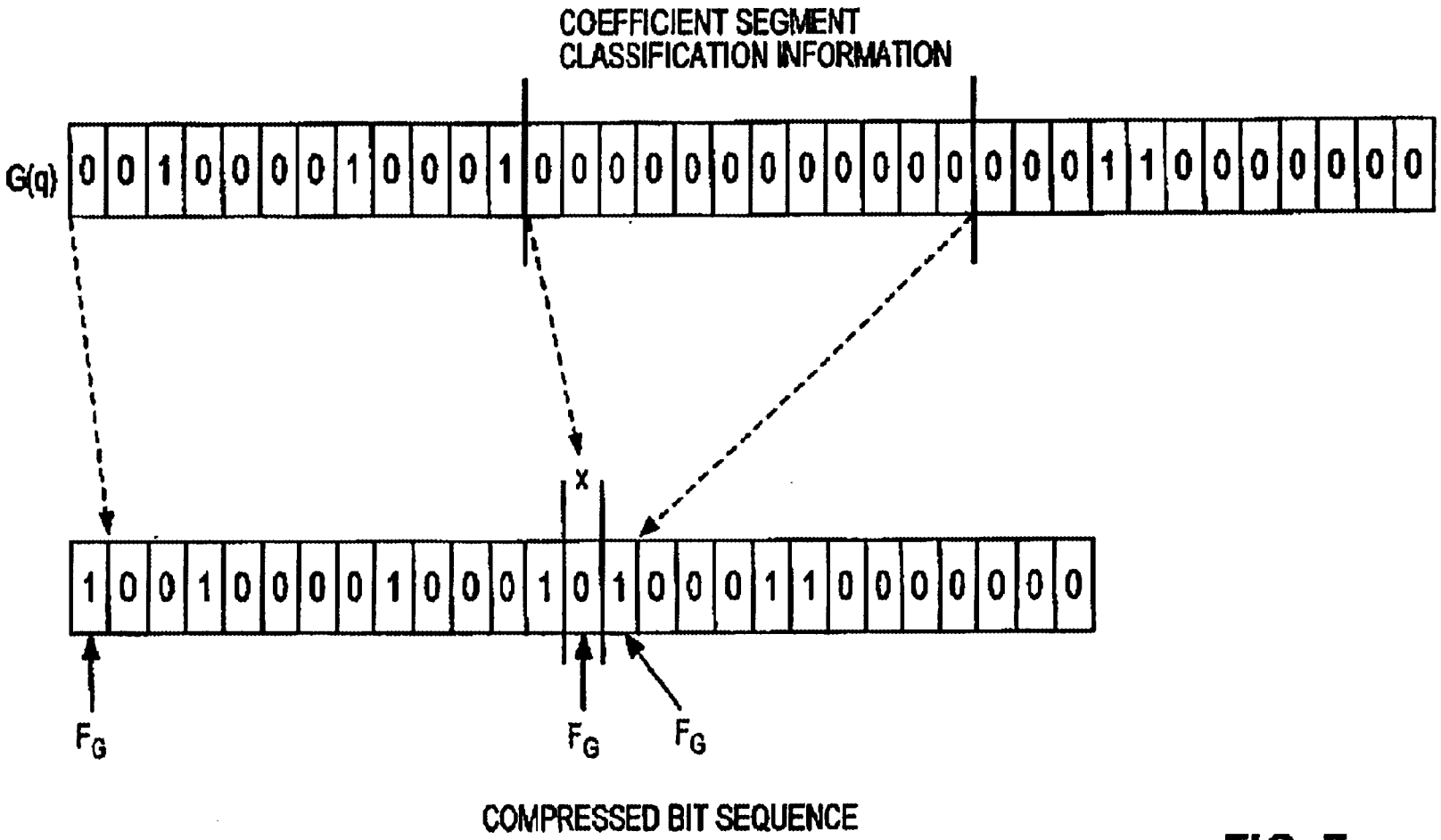
FIG. 7 is a diagram schematically showing the operation of a coefficient segment classification information compressing part 15 in the first, second and third embodiments of the present invention.

Alternatively, it is possible to reduce the number of bits as a whole by such a method as depicted in FIG. 7. The sequence of coefficient segment classification information G(q), where q=0,1, . . . ,Q−1, is divided into some blocks, and when the block concerned has no coefficient segment classification information G(q) of the value 1, a flag FG indicated by one bit is set to 0 and only the flag $F_G$ is used to represent the block. When the block has the coefficient segment classification information G(q) of the value 1, the flag $F_G$ is set to 1, then the flag $F_G$=0 is added to the front of the block, and the coefficient segment classification information G(q) in the block is represented by one bit. This permits reduction of the number of bits involved. Furthermore, the coefficient segment classification information with the reduced number of bits may be subjected to, for instance, the afore- mentioned Huffman or arithmetic coding.

First Quantization Part 16

The first quantization part 16 encodes the coefficients that form the segment group $E_{g0}$ classified in the coefficient segment classifying part 14.

The coding of the segment group $E_{g0}$ is preceded by its transformation into a single sequence of coefficients as expressed by the following equation:

$$C_0(s \cdot M+m)=E_{g0}(S, m)$$

where s=0, 1, . . . , $S_0$, m=0, 1, . . . , M−1

The coding may be done by: a method (A) which divides the coefficients forming the coefficient sequence $C_0$ into some subblocks, then adaptively allocates the number of quantization bits to each subblock, and applies scalar quantization to each subblock; a method (B) which divides the coefficients forming the coefficient sequence $C_0$ into some subblocks, then determines the optimum quantization step width for each subblock, and applies scalar quantization to each subblock, followed by such entropy coding as Huffman or arithmetic coding; a method (C) which applies vector quantization to the coefficient sequence $C_0$ in its entirety; and a method (D) which applies to interleave vector quantization to the coefficient sequence $C_0$ in its entirety.

The information quantized by the method A, C, or D is fed to the multiplexing part 18 after transformation of the quantization index $In_{E0}$ into a bit string through binarization with the necessary and minimum number of bits. In the case of using the method B, the bit string is provided intact to the multiplexing part 18.

Furthermore, the size $S_0$ of the segment group $E_{g0}$ from the coefficient segment classifying part 14 is also transformed into a bit string through binarization with a predetermined number of bits, thereafter being provided to the multiplexing part 18.

Second Quantization Part 17

The second quantization part 17 encodes the coefficients forming the segment group $E_{g1}$ classified in the coefficient segment classifying part 34. The coding is performed following a procedure similar to that used in the first quantization part 16, the coding method need not necessarily be the same as that of the latter.

The coding of the segment group $E_{g1}$ is preceded by its transformation into a single sequence of coefficients as expressed by the following equation:

$$C_1(s \cdot M+m)=E_{g1}(s, m)$$

where: s=0, 1, . . . , $S_1$, m=0, 1, . . . , M−1

The coding may be done by: a method (A) which divides the coefficients forming the coefficient sequence $C_1$ into some subblocks, then adaptively allocates the number of quantization bits to each subblock, and applies scalar quantization to each subblock; a method (B) which divides the coefficients forming the coefficient sequence $C_1$ into some subblocks, then determines the optimum quantiation step width for each subblock, and applies scalar quantization to each subblock, followed by such entropy coding as Huffman or arithmetic coding; a method (C) which applies vector quantization to the coefficient sequence $C_1$ in its entirety; and a method (D) which applies to interleave vector quantization to the coefficient sequence $C_1$ in its entirety.

The information encoded by the method A, C, or D is fed to the multiplexing part 18 after transformation of the quantization index $In_{E1}$ into a bit string through binarization with the necessary and minimum number of bits. In the case of using the method B, the bit string is provided intact to the multiplexing part 18. Furthermore, the size $S_1$ of the segment group $E_{g1}$ from the coefficient segment classifying part 14 is also transformed into a bit string through binarization with a predetermined number of bits, thereafter being fed to the multiplexing part 18.

In any case, the coding method in the second quantization part 17 need not be the same as that used in the first quantization part 16. Rather, it is preferable to use different coding methods suited to the first and second quantization parts 16 and 17 based on the difference in property between the coefficient segment groups $E_{g0}$ and $E_{g1}$ that are provided thereto. This permits reduction of the amount of information to be coded and suppression of distortion by code errors.

Multiplexing Part 18

The multiplexing part 18 outputs, as a bit string or sequence, all pieces of input information G(q)*, $In_{E0}$ and $In_{E1}$ from the coefficient segment classification information compressing part 15 and the first and second quantization parts 16 and 17. The output bit sequence from the multiplexing part 18 is the output from the coding part 10, which is provided to the demultiplxing part 31 of the decoding part 30.

The decoding part 30 will be described below.

Demultiplexing Part 31

The demultiplexing part 31 receives the bit sequence output from the coding part 10, and follows a procedure reverse to that of multiplexing part 18 to break down the input bit sequence into bit sequences $In_{E0}$, $In_{E1}$ and G(q)* for input to the first inverse-quantization part 32, the second inverse-quantization part 33 and the coefficient segment classification information decompressing part 34, respectively.

First De-Quantization part 32

The first inverse-quantization part 32 inverse-quantizes or reconstructs the bit sequence from the demultiplexing part 31 and outputs the coefficient segment group $E_{g0}$ and its size $S_0$. The size $S_0$ is reconstructed by transforming into an integer a size-indicating bit sequence binarized with a predetermined number of bits.

The bit sequence representing the segment group $E_{g0}$ is inverse-quantized into a coefficient sequence $C_0^q$ by following a procedure reverse to that of the quantization method A, B, C, or D used in the first quantization part 16, after which the segment group $E_{g0}^q$ is reconstructed as expressed by the following equation:

$$E_{g0}^q(s, m)=C_0^q(s \cdot M+m),$$

where s=0, 1, . . . , $S_1$−1, m=0, 1, . . . ,M−1

The superscript "q" affixed to the symbols $C_0$ and $E_{g0}$ indicates that since the quantization by the first quantization part 16 causes quantization errors, the decoded $C_0^q$ and $E_{g0}^q$ include quantization errors with respect to $C_0$ and $E_{g0}$. The same applies to the superscript "q" affixed to the other symbols.

Second De-Quantization Part 33

The second inverse-quantization part 33 inverse-quantizes or reconstructs the bit sequence from the demultiplexing part 31 and outputs the coefficient segment group $E_{G1}$ and its size $S_1$. The size $S_1$, is reconstructed by transforming into an integer a size-indicating bit sequence binarized with a predetermined number of bits.

The bit sequence representing the segment group $E_{G1}$ is inverse-quantized into a coefficient sequence $C_1^q$ by following a procedure reverse to that of the quantization method A, B, C, or D used in the second quantization part 17, after which the segment group $E_{g1}^q$ is reconstructed as expressed by the following equation:

$$E_{g1}^q(s, m)=C_1^q(s \cdot M+M),$$

where s=0, 1, . . . , $S_1$−1, m=0, 1, . . . ,M−1

Coefficient Segment Classification Information Decompressing Part 34

The coefficient segment classification information decompressing part 34 decompresses the bit sequence from the demultiplexing part 31 by reversing the procedure of the reversible compression coding method used in the coefficient segment classification compressing part 15, thereby reconstructing coefficient segment classification information G(q), where q=0, 1, . . . , Q−1. When the first and second quantization parts 16 and 17 in the coding part 10 use different coding methods, it is a matter of course that the first and second inverse-quantization parts 32 and 33 of the decoding part 30 use different decoding methods accordingly.

Coefficient Combining Part 35

The coefficient combining part 35 uses the coefficient segment classification information G(q) from the coefficient segment classification information decompressing part 34 to recombine the segment groups from the first and second inverse-quantization parts 32 and 33 into a single sequence and outputs frequency-domain coefficients.

Figure 8:
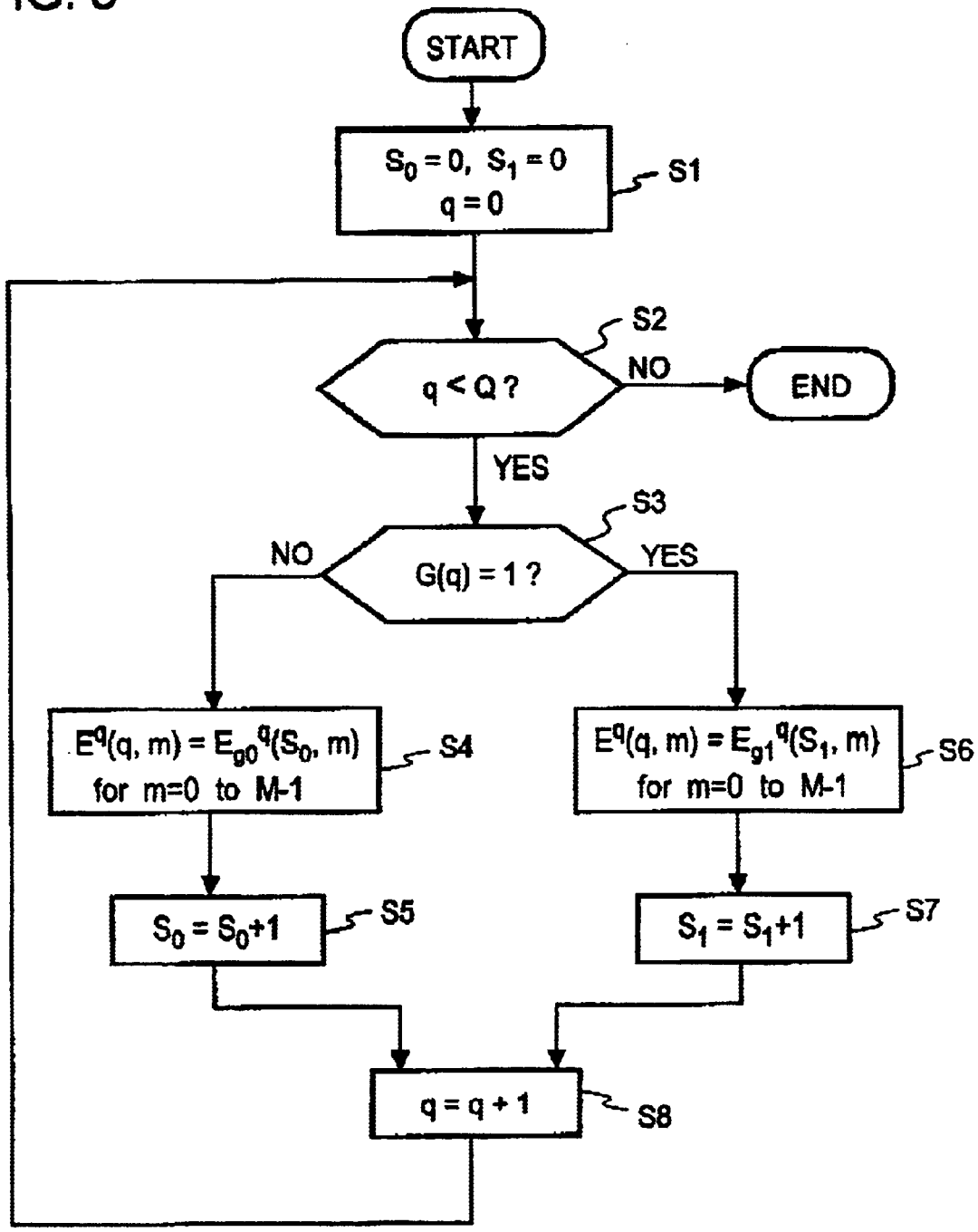
FIG. 8 is a process flow diagram of a coefficient combining part 35 in the first, second and third embodiments of the present invention.

FIG. 8 is a flowchart showing the procedure by which the coefficient combining part 35 obtains a sequence of coefficient segments $E^q$. In step S1 the values $S_0$, $S_1$ and q are initialized to zeros. In step S2 it is determined whether q is smaller than Q; if so, it is determined in step S3 whether the coefficient segment classification information G(q) is 1. If not, it is defined in step S4 that the coefficient segment $E_{g0}{}^q(S_0, m)$ is $E^q(q, m)$, then in step S5 the value SO is incremented by one, and in step S8 the value q is incremented by one, followed by a return to step S2. If it is determined in step S3 that the information G(q) is 1, the coefficient segment $E_{g1}{}^q(S_1, m)$ is defined to be $E^q(q, m)$ in step S6, then in step S7 the value S1 is incremented by one, and in step S8 the value q is incremented by one, followed by a return to step S2. When it is determined in step S2 that q is not smaller than Q, the process is finished and the sequence of coefficient segments E (q, m), where q=0, 1, . . . , Q−1, m=0, 1, . . . , M−1.

The sequence of coefficient segments $E^q$ is restructured to the following frequency-domain coefficient $X^q$ by following a procedure reverse to that in the coefficient segment generating part 12.

$$X^q(q \cdot M+m)=E^q(q, m),$$

where q=0, 1, . . . , Q−1; m=0, 1, . . . , M−1

Frequency-Time Transform Part 36

The frequency-time transformation part 36 frequency-time transforms the sequence of coefficients $X^q(q \cdot M+m)$ from the coefficient combining part 35 to generate an audio signal $X^q$, and outputs it.

The frequency-time transform can be done by inverse discrete cosine transform (IDCI) or inverse modified discrete cosine transform (IMDCT). In the case of using the inverse modified discrete cosine transform, N input coefficients are transformed into 2N time-domain samples. These samples are multiplied by a window function expressed by the following equation, after which N samples in the first half of the current frame and N samples in the latter half of the previous frame are added together to obtain N samples, which are output.

$$W(i)=0.5\{1-\cos[2\pi(0.5+i)/N]\},\ i=0, 1, \ldots, N-1$$

A mathematical expression of the above processing in the case of inverse discrete cosine transform is as follows:

$$Z^t(i) = W(i)\sum_{k=0}^{N-1} X^q(k)\cos(\pi/N)[i+(N+1)/2](k+1/2)$$

$$x^q(i)=Z^{t-1}(i+N)+Z(i),\ i=0,1, \ldots ,N-1$$

where $x^q(i)$ is the output audio sample signal.

SECOND EMBODIMENT

Figure 9:
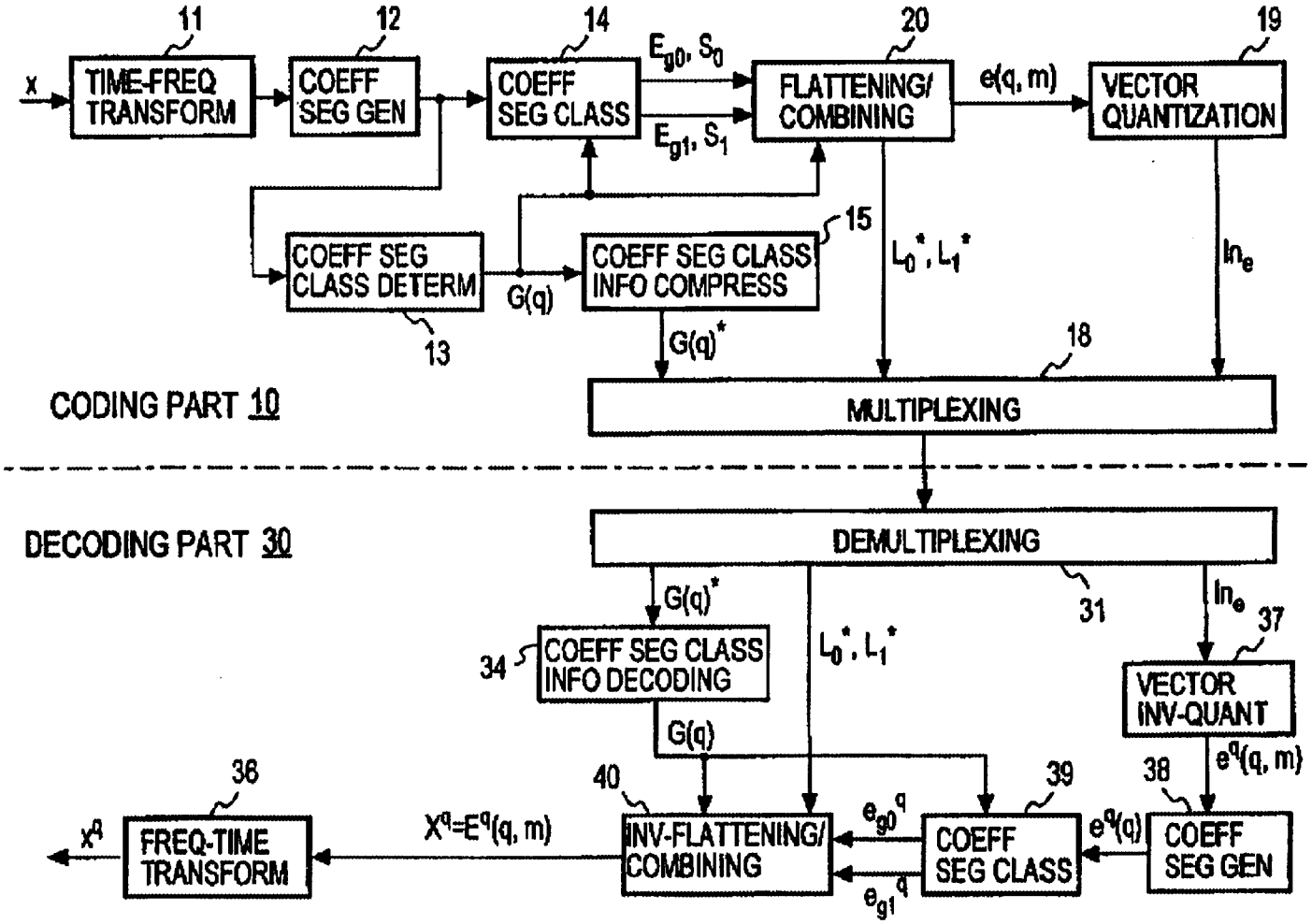
FIG. 9 is a block diagram illustrating the functional configuration of the second embodiment of the present invention.

FIG. 9 illustrates in block form a second embodiment of the present invention. In FIG. 9, processing parts 11, 12, 13, 14, 15, 19 and 20 constitute the coding part 10, which receives an input audio signal in the form of a sample sequence and outputs a coded bit sequence. Processing parts 31, 34 and 36 through 40 make up the decoding part 30, which receives the coded bit sequence and outputs an audio signal in the form of a sample sequence.

The parts corresponding to those in the first embodiment are identified by the same reference numerals. No detailed description will be repeated for the processing parts 11 to 15 of the coding part 10 since they perform the same processes as those of the corresponding parts in the first embodiment.

Figure 10:
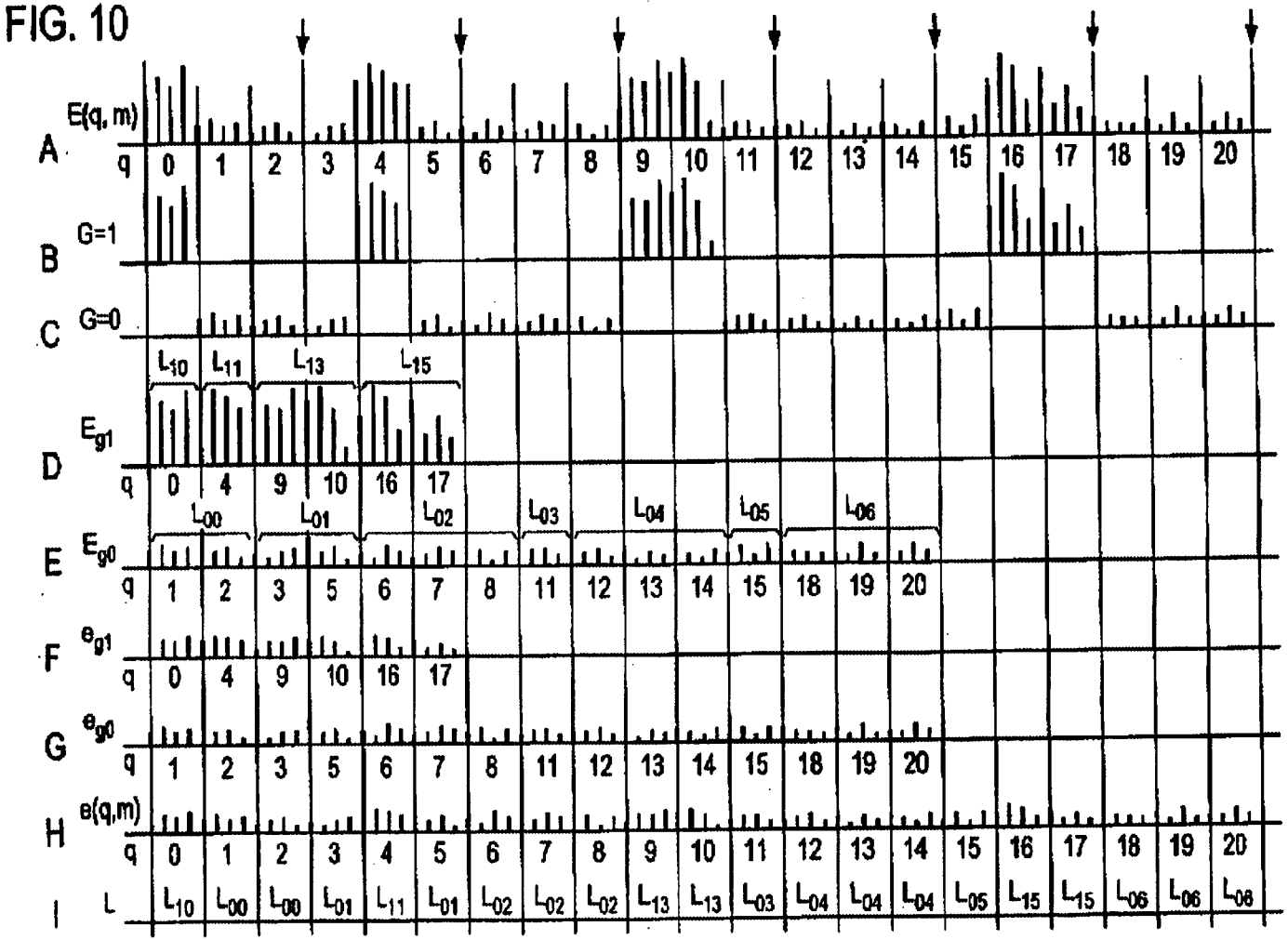
FIG. 10 is a diagram for explaining the flattening of frequency-domain coefficients in the second and third embodiments of the present invention.

FIG. 10 is a diagram for explaining the flattening of frequency-domain coefficients in this embodiment. Row A shows the state in which the frequency-domain coefficients provided from the time-frequency transformation part 11 are defined as a coefficient segment E(q, m) by the coefficient segment generating part 12. Rows B and C separately show the coefficient segment of the group G(q)=1 and the coefficient segment of the group G(q)=0 determined by the coefficient segment classification determining part 12. Rows D and E show two contiguous sequences of classified coefficient segments provided from the coefficient segment classifying part 14, that is, two coefficient segment groups $E_{g0}$ and $E_{g1}$. The processing of the coefficient segments shown on Rows A through E is the same as in the case of the first embodiment.

The coefficient segment groups $E_{g0}$ and $E_{g1}$ (Rows E and D) from the coefficient segment classifying part 14 and their sizes $S_0$ and $S_1$ are fed to the flattening/combining part 20. At the same time, the coefficient segment classification information G(q) from the coefficient segment classification determining part 13 is also input to the flattening/combining part 20. In the flattening/combining part 20, the coefficient segments in the respective coefficient segments are sequentially flattened through normalization with representative value levels $L_0=L_{00}$, $L_{01}$, $L_{02}$, $L_{03}$, $L_{04}$, $L_{05}$, $L_{06}$ (Row E) and $L_1=L_{10}$, $L_{11}$, $L_{13}$, $L_{15}$ (Row D) of their original subbands determined based on the coefficient values thereof. These two groups of coefficient segments thus flattened (Rows G and F) are arranged at their original positions on the same frequency axis based on the coefficient segment classification information G(q) to obtain a sequence of flattened frequency-domain coefficients e(q, m) (Row H), which is provided to the vector quantization part 19. And, the pieces of coefficient segment flattening information $L_0$ and $L_1$ used for flattening are encoded and provided as $L_0{}^*$ and $L_1{}^*$ to the multiplexing part 18. The representative values $L_0$ and/or $L_1$ of the coefficient segments for the same subband for such a reason as follows: The coefficient values of subbands spaced one or more subbands apart in frequency are likely to greatly differ, and when they are normalized together, the flatness is not so much improved.

Vector Quantization Part 19

The vector quantization part 19 vector quantizes the frequency-domain coefficients provided from the flattening/combining part 20, and sends a coded index Ine to the multiplexing part 18. The vector quantization may preferably be weighted interleave vector quantization. The multiplexing part 18 multiplexes the coded index $In_e$ from the vector quantization part 19, together with the compressed classification information G(q)* from the coefficient segment classification information compressing part 15 and the coefficient segment flattening information $L_0$* and $L_1$* from the flattening/combining part 20, and sends the multiplexed output to, for instance, the decoding part 30.

The decoding part 30 in this embodiment will be described below.

Vector De-Quantization Part 37

The vector inverse-quantization part 37 inverse-quantizes, for example, by referring to a codebook, the vector quantization index Ine from the demultiplexing part 31 to, uses it to obtain a sequence of flattened frequency-domain coefficients $^{eq}$(q, m), and sends it to the coefficient segment generating part 38.

Coefficient Segment Generating Part 38

The coefficient segment generating part 38 uses the same method as that in the coefficient segment generating part 12 of the first embodiment (FIG. 4) to divide the sequence of flattened frequency-domain coefficients $e^q$(q, m) into flattened coefficient segments $e^q$(q), where q=0, 1, . . . , Q−1.

Coefficient Segment Classifying Part 39

Based on the coefficient segment classification information G(q)=0 or 1 from the coefficient segment classification information decompressing part 34, the coefficient segment classifying part 39 classifies the flattened coefficient segments $e^q$(q) into flattened coefficient segment groups $e_{g0}{}^q$ (size $S_0$) and $e_{g1}{}^q$ (size $S_1$) by the same method as in the coefficient segment classifying part 14 in the FIG. 4 embodiment.

The inverse-flattening/combining part 40 uses the flattening information $L_g$=($L_0$, $L_1$), $L_0$=$L_{00}$, $L_{01}$, $L_{02}$, $L_{03}$, $L_{04}$, $L_{05}$, $L_{06}$, . . . ; and $L_1$ =$L_{10}$, $L_{11}$, $L_{13}$, . . . , $L_{15}$ to inverse-flattens the flattened coefficient segment groups egoq and $e_{g1}{}^q$ for each subregion, that is, calculates $E_{g0}{}^q$=$e_{g0}{}^q L_0$ and $E_{g1}{}^q$= $e_{g1}{}^q L_1$, then sequentially extracts the coefficient segments from the group $E_{g0}{}^q$ or $E_{g0}{}^q$ in accordance with the classification information G(q)=0 or 1 and arranges them on the same frequency axis, thereby obtaining coefficient segments EA(q) over the entire band. The frequency-time transformation part 36 transforms the entire-band coefficient segments EA(q) into a time-domain signal X and outputs it.

Figure 11A:
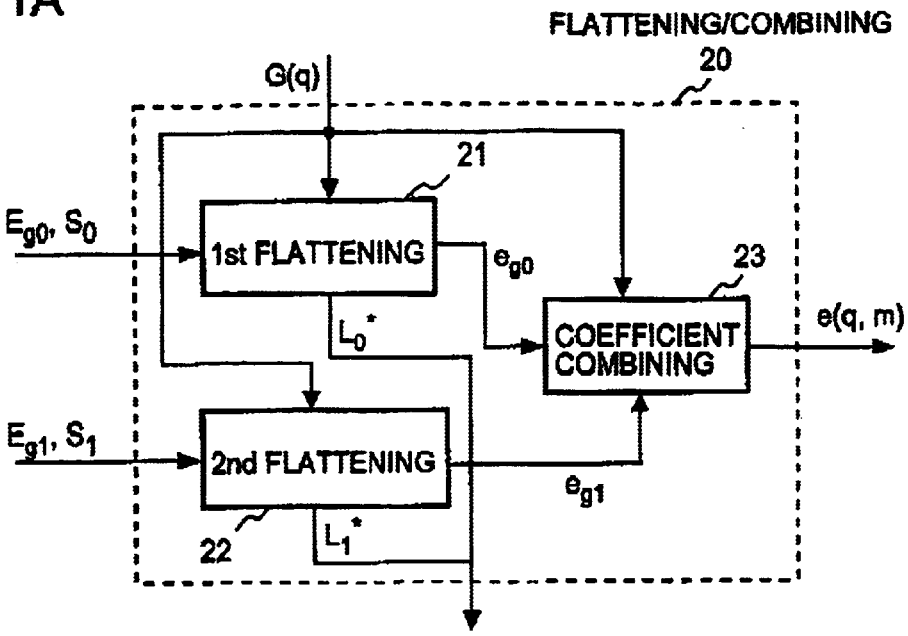
FIG. 11A is a block diagram depicting an example of the configuration of a flattening/combining part 20 in FIG. 9.
Figure 11B:
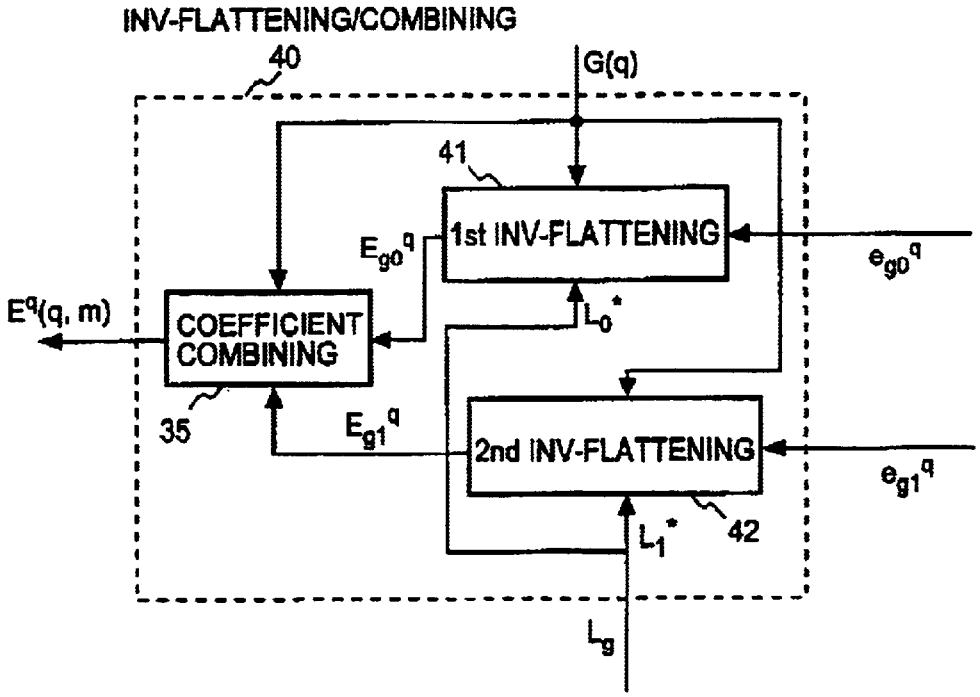
FIG. 11B is a block diagram depicting an example of the configuration of an inverse-flattening/combining part 40 in FIG. 9.

FIGS. 11A and 11B illustrate in block form examples of configurations of the flattening/combining part 20 and the inverse-flattening/combining part 40 in the second embodiment described above with reference to FIG. 9. The coefficient segment group $E_{g0}$ and its size $S_0$, which are provided from the coefficient segment classifying part 14, are input to the first flattening part 21. The coefficient segment group $E_{g0}$ and its size $S_1$, which are also provided from the coefficient segment classifying part 14, are input to the second flattening part 22.

First Flattening Part 21

The first flattening part 21 flattens the coefficient segment group $E_{g0}$ from the coefficient segment classifying part 14, using the coefficient segment classification information G(q) as auxiliary information. The flattening of the coefficient segment group $E_{g0}$ is a process that calculates a representative value for each of the plural coefficient segments (subbands) and normalizes the coefficients forming all the coefficient segments of each subband by the calculated representative value.

In the case of executing the overall processing of the coding part 10 and the decoding part 30 under the control of a computer program, handling of all the coefficient segments at prescribed positions on a liner frequency axis increases the number of processes common to coding and decoding and hence permits simplification of structures of coding and decoding programs. Therefore, a description will be given below of an example which flattens the coefficient segments of the coefficient segment group $E_{g0}$ at the original positions on the frequency axis to obtain the original group of contiguous coefficient segments. However, the computational complexity of this method is greater than that of the method which does not flatten the coefficient segments at the original position on the frequency axis as described later on, and the storage capacity necessary for processing is also large. The same is true of the second flattening part 22.

Figure 12:
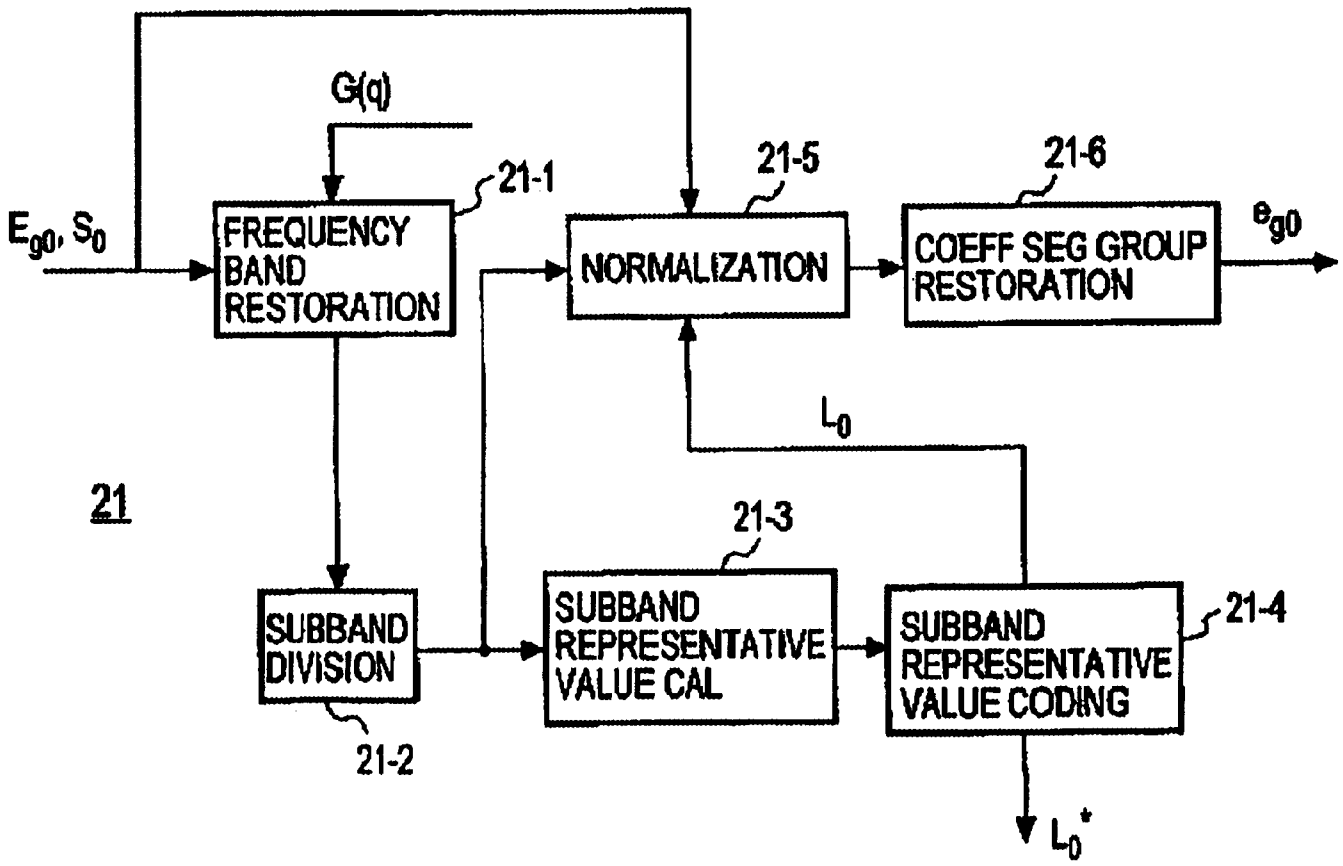
FIG. 12 is a block diagram illustrating a detailed functional configuration of a first flattening part 21 in the second and third embodiments of the present invention.

FIG. 12 illustrates in block form an example of the configuration of the first flattening part 21.

In a frequency band restoring part 21, the coefficient segments $E_{g0}$(s, m), where s=0,1, . . . ,$S_0$, which form the input coefficient segment group $E_{g0}$, are developed or expanded to the coefficient segment group EA covering the entire band (see FIG. 10, Row C) based on the coefficient segment classification information G(q). The coefficient segment group EA is fed to a subband dividing part 21-2.

Figure 13:
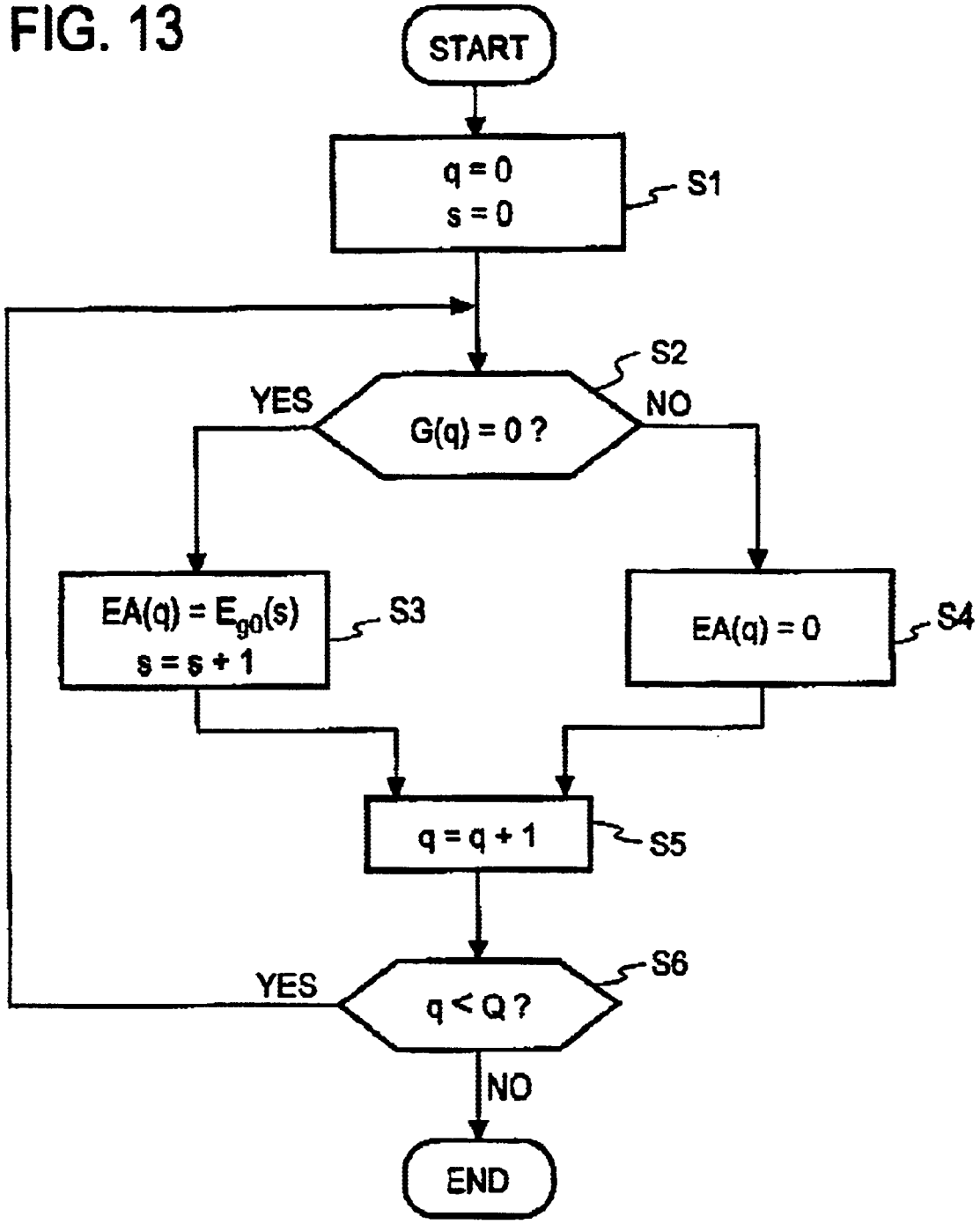
FIG. 13 is a process flow chart of a frequency band reconstructing part 21-1 of the flattening part in the second and third embodiments of the present invention.

FIG. 13 is a flowchart showing the procedure of the frequency band restoring part 21-2 for the coefficient segment group $E_{g0}$(s, m) where s=0, 1, . . . , $S_0$.

In step S1 the values q and S are initialized to zero, and in step S2 it is determined whether the coefficient segment classification information G(q) from the coefficient segment classifying part 13 is 0. If it is 0, then in step S3 an s-th coefficient segment $E_{g0}$(s, m) of the coefficient segment group $E_{g0}$ is arranged on the original frequency axis as a q-th coefficient segment EA(q) in the entire band (q=0, 1, . . . , Q−1), and the values q and s are each incremented. If the coefficient segment classification information G(q) is not zero I step S3, then in step S4 coefficients 0 (M) are arranged on the original frequency axis as a q-th coefficient segment EA(q) in the entire band. In step S6 it is determined whether q is smaller than Q; if so, the process returns to step S2, repeating steps S2, S3, S4 and S5. If q is not smaller than Q in step S6, restoration of the coefficient segment group $E_{g0}$ to the entire band is finished.

In the subband dividing part 21-2 the sequence of coefficient segments EA expanded over the entire band is split into subbands. The bandwidths of the subbands may be held constant over the entire band, or may be wider in higher frequency bands. The coefficient segments thus split into the subbands are provided to a subband representative value calculating part 21-3 and a normalization part 21-5.

The subband representative value calculating part 21-3 calculates the representative value for each subband. The representative value may be the maximum one of absolute values of the coefficients in the subband, or the square root of an average of those of the powers of the coefficients in the subband which are larger than 0. The calculated representative value is provided to a subband representative value coding part 21-4.

The subband representative value coding part 21-4 encodes the representative value of each subband. To begin with, the subband representative value is scalar quantized to obtain a quantized index $L_0$*. If the quantized index is 0, no representative value is coded. Only representative values of quantized indexes greater than 0 are fed as the coefficient flattening information to the multiplexing part 18. An alternative is to apply interleave vector quantization to the representative values. The quantized representative values $L_0$ are provided to the normalization part 21-5.

In the normalization part 21-5, the coefficient segments $E_{g0}$ split into subbands from the subband dividing part 21-2 are normalized using the quantized subband representative values generated in the subband representative coding part 21-4. The normalized, that is, the flattened coefficient segments $e_{g0}$ are provided to a coefficient segment group reconstructing part 21-6.

The coefficient segment group restoring part 21-6, the entire band coefficient segments normalized by reversing the procedure of the frequency band restoring part 21-1 are restored to the flattened coefficient segment group, which is output from the first flattening part 21.

Second Flattening Part 22

The second flattening part 22 is identical in construction to the first flattening part 21, and follows the same procedure as that of the latter to flatten the coefficient segment group $E_{g1}$ fed from the coefficient segment classifying part 14, using the coefficient segment classification information G(q) as auxiliary information. The procedure is the same as that of the first flattening part 21, but in the steps corresponding to those of the frequency band restoring part 21-1 and the coefficient segment group restoring part 21-6 the processes for the coefficient segment classification information G(q) of the value 1 and 0 are exchanged. Incidentally, the coefficient segment group $E_{g1}$ does not exist in some of the subbands, but in such subbands the flattening by the second flattening part 22 is not performed. This applies to every process by the second flattening part 22 described later on.

Coefficient combining Part 23

By the same method as that of the coefficient combining part 35 in the first embodiment, the coefficient combining part 23 combines the coefficient segment groups flattened in the first and second flattening parts 21 and 22, respectively, to obtain flattened frequency-domain coefficients.

In the inverse-flattening/combining part 40 in FIG. 9, the coefficient segment groups $e_{g0}^q$ and $e_{g1}^q$ received from the coefficient segment classifying part 39 are inverse-flattened using the decoded coefficient segment flattening information $L_0$ and $L_1$, and in accordance wit the coefficient segment classification information G(q) these two groups of inverse-flattened coefficient segments $E_{g0}^q$, $E_{g1}^q$ are combined into a single sequence of frequency-domain coefficients, $E^q(q, m)$, which are output from the inverse-flattening/combining part 40.

First De-Flattening Part 41

Figure 14:
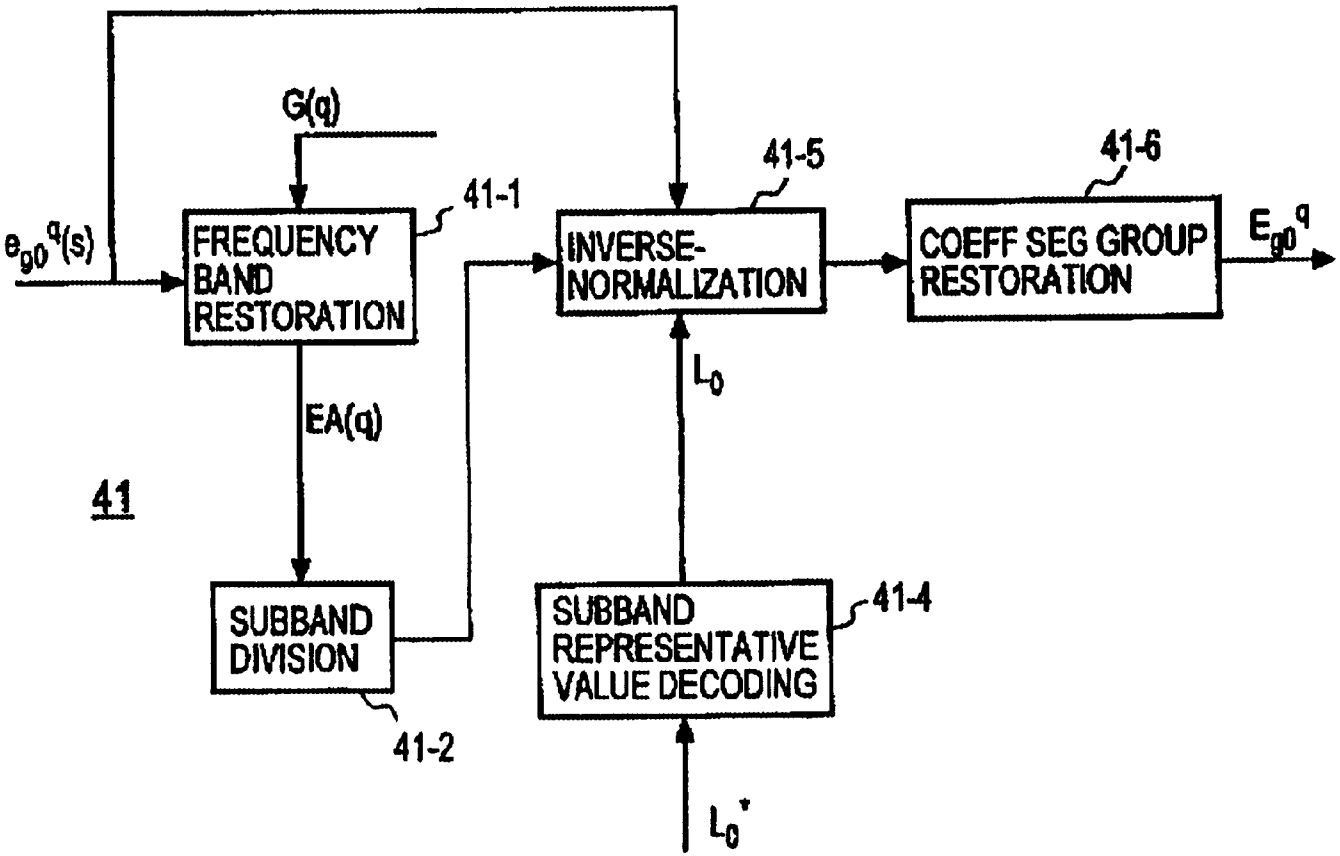
FIG. 14 is a block diagram depicting an example of the functional configuration of a first inverse-flattening part 41 in FIG. 11B.

FIG. 14 illustrates in block form the configuration of the first inverse-flattening part 41 in FIG. 11B corresponding to the first flattening part 21 in FIG. FIG. 12. The first inverse-flattening part 41 inverse-flattens the flattened coefficient segment group $e_{g0}^q$ through utilization of the flattening information $L_0$* and $L_1$* provided from the demultiplexing part 31. That is, as depicted in FIG. 14, in a frequency band restoring part 41 the flattened coefficient segments $e_{g0}^q(s)$, where s=0,1, . . . ,$S_0$, which form the input flattened coefficient segment group $e_{g0}$, are expanded into the sequence of coefficient segments EA(q) covering the entire band based on the coefficient classification information G(q). This sequence of coefficient segments EA(q) is provided to a subband dividing part 41-2.

In the subband dividing part 41-2, the sequence of coefficient segments EA(q) expanded over the entire band is split into subbands. The bandwidths of the subbands may be held constant over the entire band, or may be wider in higher frequency bands. The coefficient segments split into the subbands are provided to a inverse-normalizing part 41-5.

In a subband representative value decoding part 41-4, the coefficient segment flattening information $L_0$* input thereto is decoded by a decoding method corresponding to the coding method used in the subband representative value coding part 21-4 (FIG. 12) to obtain the subband representative value $L_0$.

In the inverse-normalizing part 41-5, the flattened coefficient segments $e_{g0}^q$ split into the subbands, provided from the subband dividing part 41-2, are inverse-normalized using the subband representative value $L_0$ decoded in the subband representative value decoding part 41-4.

In a coefficient segment group restoring part 41-6, the inverse-normalized coefficient segments are restored into the coefficient segment group through processing reverse to that in the frequency band restoring part 41-1, and the thus restored coefficient segment group is used as the output $E_{g0}^q$ from the first inverse-flattening part 41.

Second De-Flattening Part 42

The second inverse-flattening part 42 in FIG. 11B is identical in construction to the above-described first inverse-flattening part 41 in FIG. 14, and inverse-flattens the flattened coefficient segment group $e_{g1}^q$, using the subband representative value $L_1$ derived from the flattening information $L_1$* provided from the demultiplexing part 31. The inverse-flattening procedure is the same as that of the first inverse-flattening part 41, but in the steps corresponding to those of the frequency band restoring part 41-1 and the coefficient segment group restoring part 41-6 the processes for the coefficient segment classification information G(q) of the value 1 and 0 are exchanged. Incidentally, the coefficient segment group $e_{g1}^q$ does not exist in some of the subbands, but in such subbands the inverse-flattening by the second inverse-flattening part 42 is not performed. This applies to every process by the second inverse-flattening part 42 described later on.

The frequency-time transformation part 36 transforms the frequency-domain coefficients $X^q=E^q(q, m)$ from the inverse-flattening/combining part 40 into time-domain signals $x^q$ as in the frequency-time transformation part 36 in FIG. 4.

Figure 15:
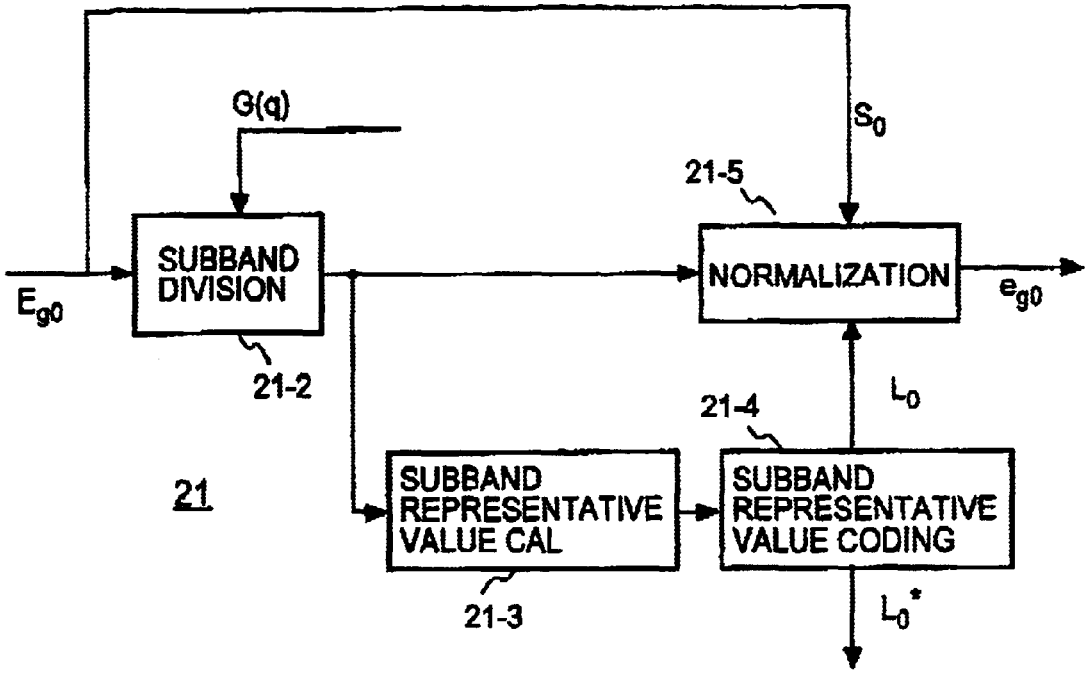
FIG. 15 is a block diagram depicting another example of the functional configuration of the first flattening part 21 in FIG. 11A.

In the FIG. 12 which shows an example of the flattening part 21 (or 22) in FIG. 11A, the coefficient segments are restored first over the entire band and then to the coefficient segment group by being flattened through normalization. FIG. 15 depicts an example of the configuration of the flattening part 21 which directly normalizes the coefficient segment group without restoring it over the entire band. In this example, the subband dividing part 21-2 splits the coefficient segment group $E_{g0}$, fed from the coefficient classifying part 14 along with the size $S_0$, into subbands (Row E) based on the classification information G(q) from the coefficient segment classification determining part 13, and obtain the correspondence between the subbands and the classification information G(q). The subband representative value calculating part 21-3 may use for each subband the square mean of absolute values of coefficient values or the square mean of coefficient values except zero. The subband representative value is coded in the subband representative value coding part 21-4, and the coded representative value $L_1$* is provided as the coefficient flattening information to the multiplexing part 18, while at the same time the quantized subband representative value $L_0$ obtained by decoding is provided to the normalization part 21-5, wherein the subband coefficient segments are normalized to obtain the flattened coefficient segment group $e_{g0}$. The second flattening part 2 can also similarly be configured.

Figure 16:
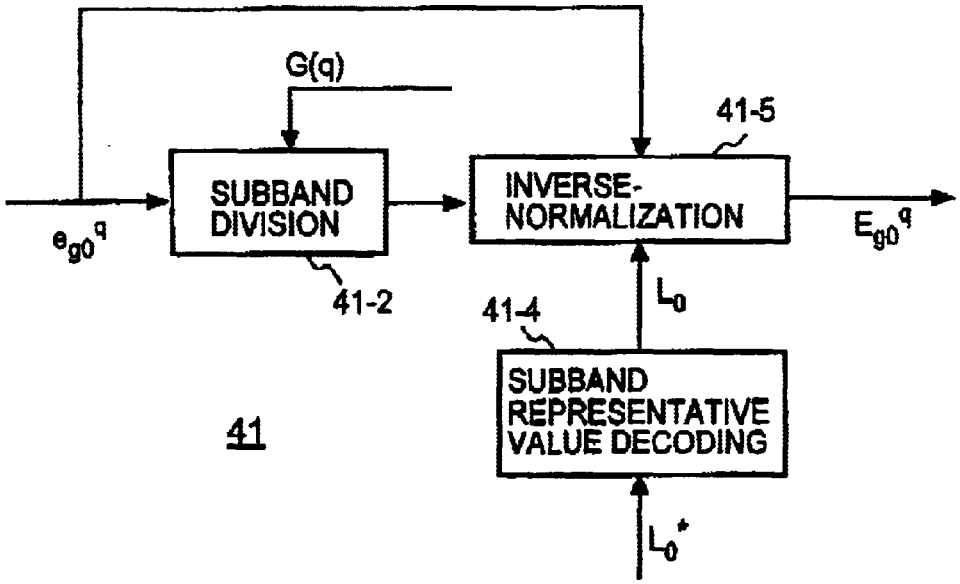
FIG. 16 is a block diagram depicting another example of the functional configuration of the first inverse-flattening part 41 in FIG. 11B.

FIG. 16 illustrates in block form an example of the configuration of the first inverse-flattening part 41 of the decoding part 30 that corresponds to the FIG. 15 configuration of the first flattening part 21. In the illustrated example, the flattened coefficient segment group $e_{g0}^q$ from the coefficient segment classifying part 39 (FIG. 9) is split by the subband dividing part 41-2 into subbands associated with the coefficient segment classification information G(q), thereafter being provided to the de-normalization part 41-5.

On the other hand, the subband representative value decoding part 41-4 decodes the coded coefficient segment flattening information $L_0$* from the demultiplexing part 31 to obtain the subband representative value $L_0$, which is provided to the de-normalization part 41-5. The de-normalization part 41-5 inverse-normalizes the coefficient segment group $e_{g0}^q$ by the subband representative value $L_0$ corresponding to each subband, thereby obtaining the inverse-flattened coefficient segment group $E_{g0}^q$.

Figure 17A:
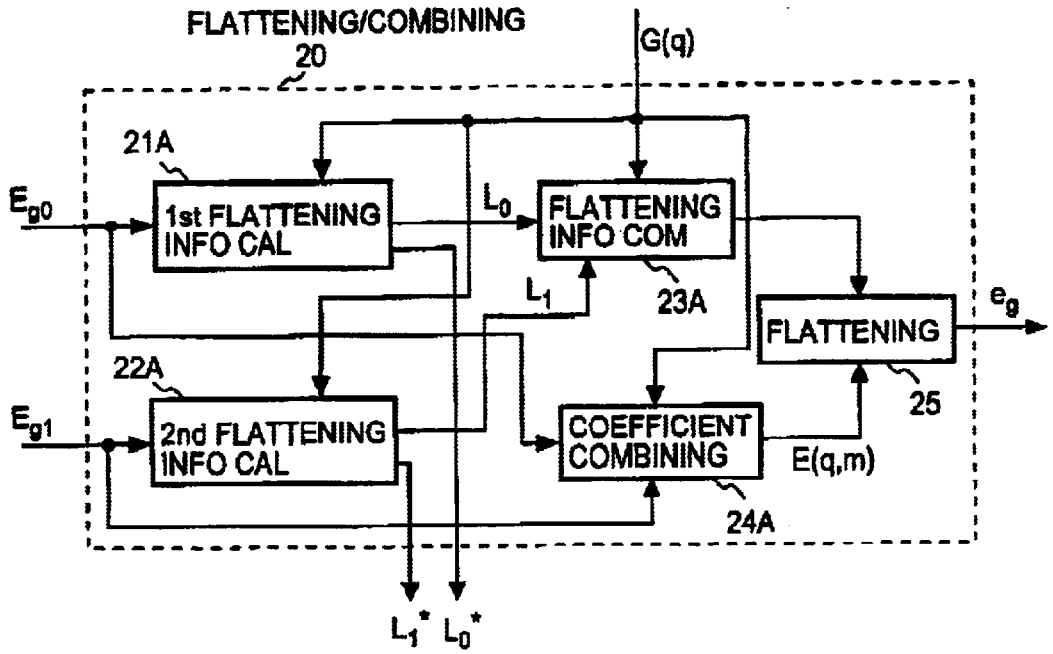
FIG. 17A is a block diagram depicting another example of the functional configuration of the flattening/combining part 20 in FIG. 9.
Figure 17B:
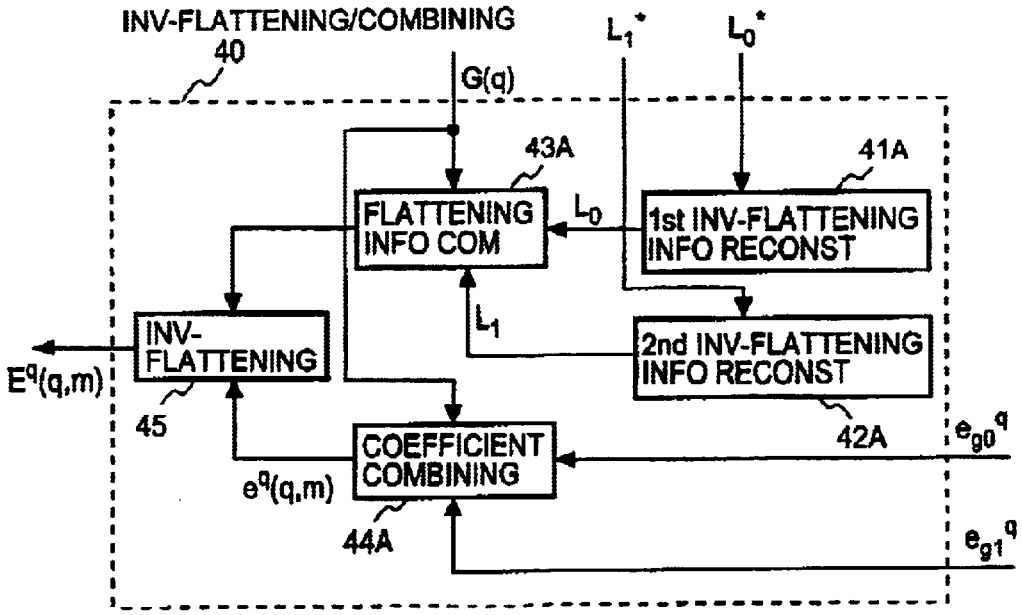
FIG. 17B is a block diagram depicting another example of the functional configuration of the inverse-flattening/combining part 40 in FIG. 9.

FIGS. 17A and 17B depict other examples of the configurations of the flattening/combining part 20 and the inverse-flattening/combining part 40 in FIG. 9, respectively. In the flattening/combining part 20 of the coding part 10, a first flattening information calculating part 21A divides the segment group $E_{g0}$ (FIG. 10, Row E) into subregions, calculates the representative values $L_{00}$, $L_{01}$, $L_{02}$, . . . of the coefficient segments in each subregion, and provides them as flattening information $L_0$(=$L_{00}$, $L_{01}$, $L_{02}$, . . . ) to a flattening information combining part 23A and the coded flattening information $L_0$* to the multiplexing part 18. The subregions are each formed by combining input coefficient segments belonging to the same subband when they are developed on the frequency axis. The subbands are preset. The representative value my be, for example, the maximum one of absolute values of coefficients in each subregion or an average value of the absolute values of the coefficients except 0. Similarly, a second flattening information calculating part 22A also divides the coefficient segment group $E_{g1}$, (FIG. 10, Row D) into subregions of the same size as in the case of the first flattening information calculating part 21A, calculates representative values $L_{10}$, $L_{11}$, . . . of the respective subregions, and provides them as flattening information $L_1$(=$L_{10}$, $L_{11}$, . . . ) to the flattening information combining part 23A and the coded flattening information $L_1$* to the multiplexing part 18.

The flattening information combining part 23A is supplied with the flattening information $L_{00}$, $L_{01}$, . . . from the first flattening information calculating part 21A and the flattening information $L_{10}$, $L_{11}$, . . . from the second flattening information calculating part 22A, extracts the pieces of flattening information from the first or second flattening information calculating part 21A or 22A, depending on whether the classification information G(q) is 0 or 1 for q=0, 1, . . . , and arranges them on the same frequency axis in a sequential order (that is, in the order of q=0, 1, . . . ), thereby obtaining a sequence of flattening information over the entire band (FIG. 10, Row I).

On the other hand, a coefficient combining part 24A is supplied with the segment groups $E_{g0}$ and $E_{g1}$ and, following the same procedure as that for combining the flattening information by the flattening information combining part 23A, extracts segments from the segment group $E_{g0}$ or $E_{g1}$, depending on whether G(q) is 0 or 1, and arranges them on the same frequency axis to obtain a sequence of coefficient segments over the entire band (that is, q=0, 1, . . . , Q−1). Incidentally, since this segment sequence is the same as the sequence of coefficient segments generated by the coefficient segment generating part 12 (FIG. 9), the coefficient combining part 24A may be dispensed with.

A flattening part 25 divides the sequence of coefficient segments E from the coefficient combining part 24A (or coefficient segment generating part 12) by the flattening information sequence from the flattening information combining part 23A for each q to obtain a flattened coefficient sequence over the entire band (FIG. 10, Row H). The thus obtained flattened coefficient sequence is provided to the vector quantization part 19 in FIG. 9.

The inverse-flattening/combining part 40 of the decoding part 30 performs, as depicted in FIG. 17B, processing reverse to that of the flattening part 20 (FIG. 17A) of the coding part 10. That is, first and second flattening information decoding parts 41A and 42A decode the flattening information $L_0$* and $L_1$* from the demultiplexing part 31A and provide the subregion representative values $L_0$ and $L_1$ to a flattening information combining part 43A. The flattening information combining part 43A combines the flattening information $L_0$ and $L_1$ into a single sequence over the entire band based on the coefficient segment classification information G(q), and provides it to an inverse-flattening part 45. A coefficient combining part 44A is supplied with the flattened coefficient segment groups $e_{g0}^q$ and $e_{g1}^q$ from the coefficient segment classifying part 39 (FIG. 9), and based on the coefficient segment classification information G(q), combines the flattened coefficient segment groups $e_{g0}^q$ and $e_{g1}^q$ into a single sequence of flattened coefficient segment $e^q$(q, m) over the entire band. The inverse-flattening part 45 is supplied with the single sequence of entire band flattened coefficient segment $e^q$(q, m) and inverse-flattens it by the single sequence of entire band flattening information from the flattening information combining part 43A to generate the frequency-domain coefficients $E^q$(q, m), which is provided to the frequency-time transformation part 36 (FIG. 9).

THIRD EMBODIMENT

Figure 18:
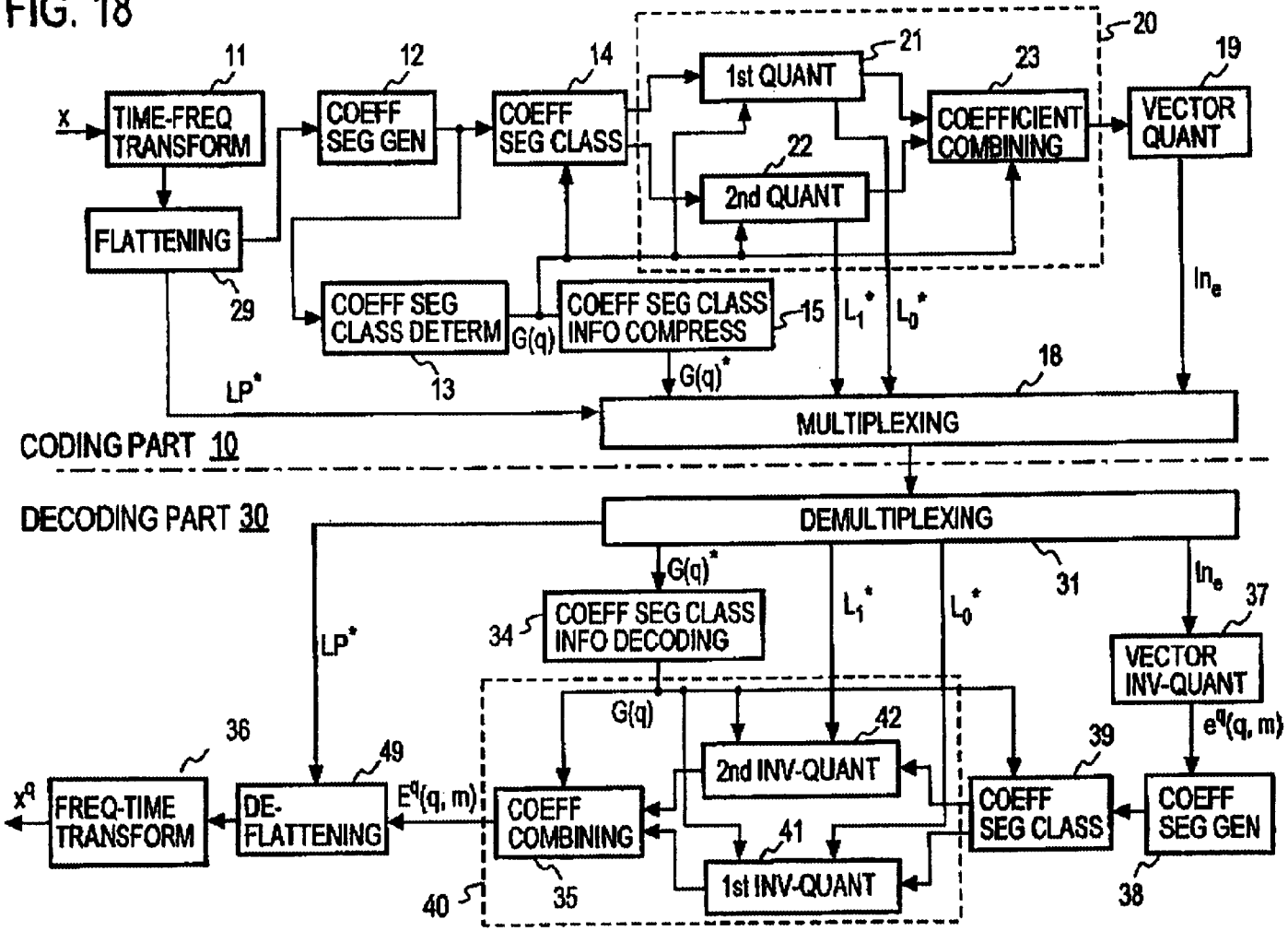
FIG. 18 is a block diagram illustrating the functional configuration of the third embodiment of the present invention.

FIG. 18 illustrates in block form a third embodiment of the present invention. This embodiment differs from the FIG. 9 embodiment in that a flattening part 29 is interposed between the time-frequency transformation part 11 and the coefficient segment generating part 12 in the coding part 10 and that an inverse-flattening part 49 is interposed between the inverse-flattening/combining part 40 and the frequency-time transformation part 36 in the decoding part 30.

Flattening part 29

The flattening part 29 flattens the frequency-domain coefficient sequence from the time-frequency transformation part 11 and sends the flattened sequence of coefficient segments to the coefficient segment generating part 12. The flattening scheme may preferably be, for instance, normalization by linear predictive coding (LPC) spectrum. In this case, the linear prediction coefficient LP used to generate the LPC spectrum is encoded and sent as auxiliary information LP* to the multiplexing part 18. Subsequent processings are similar to those in FIG. 9.

De-Flattening Part 49

The inverse-flattening part 49 generates an LPC spectrum from a linear prediction coefficient LP obtained by decoding linear prediction coefficient information LP* fed from the demultiplexing part 31, and uses the LPC spectrum to de-flatten the coefficient sequence $E^q$(q, m) from the inverse-flattening/combining part 40 to obtain frequency-domain coefficients, which are output to the frequency-time transformation part 36. The operations of the other parts are the same as in the FIG. 9 embodiment.

In the above, when the sample number is not needed for quantization of the first and second coefficient segment groups $E_{g0}$ and $E_{g1}$, the group sizes S0 and S1 need not be calculated. In the above the coefficient segments has been described to be classified into two groups, but they may be classified into three or more groups. While the width of the of the coefficient segment has been described to be around 100 Hz, it may be chosen suitably under 200 Hz or so, and it is also possible to make the bandwidth narrower toward the low-frequency range. Moreover, the coefficient segments need not always be divided over the entire frequency band, and the splitting of the coefficient segments over a limited frequency range falls within the scope of the present invention.

In the third embodiment depicted in FIG. 18, the first and second flattening parts 21 and 22 of the flattening/combining part 20 and the first and second inverse-flattening parts 41 and 42 of the inverse-flattening/combining part 40 may be identical in construction with the flattening part and the inverse-flattening part shown in FIGS. 12 and 14, respectively, or with those shown in FIGS. 15 and 16. Furthermore, the flattening/combining part 20 and the inverse-flattening part 40 in FIG. 18 may be replaced with those depicted in FIGS. 17A and 17B, respectively. Additionally, the FIG. 18 configuration with the flattening part 29 disposed between the time-frequency transformation part 11 and the coefficient segment generating part 12 can be applied to the first embodiment shown in FIG. 4.

Figure 19:
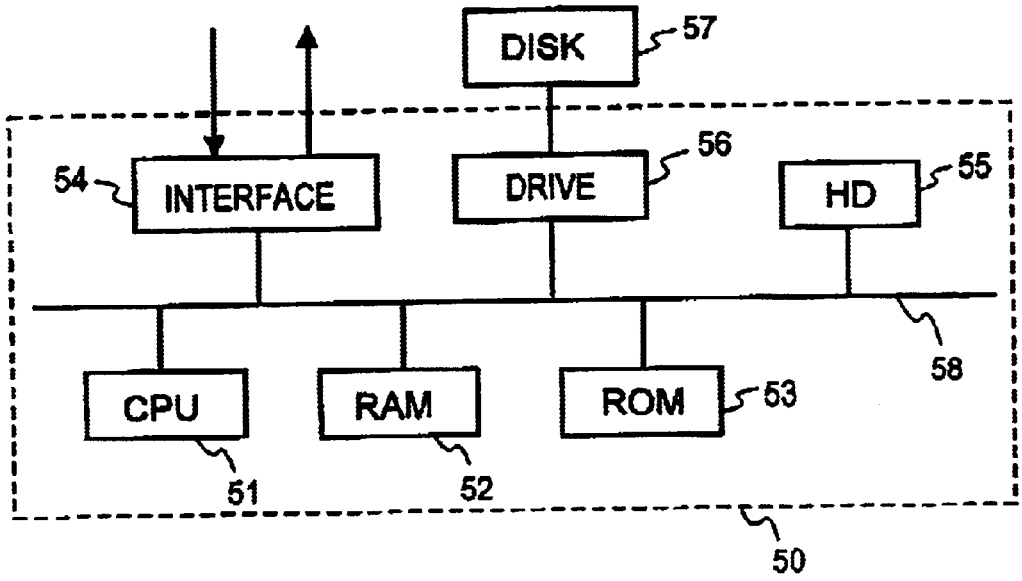
FIG. 19 is a block diagram illustrating the computer configuration for implementing the coding and decoding schemes of the present invention under program control.

FIG. 19 schematically depicts the configuration for practicing the coding and decoding methods of the present invention by a computer. The computer 50 includes CPU 51, RAM 52, ROM 53, I/O interface 54 and hard disk 55 interconnected via bus 58. The ROM 53 has written therein a basic program for the operation of the computer 50, and the hard disk 55 has prestored therein programs for carrying out the coding and decoding methods according to the present invention. For example, during coding the CPU 51 loads the coding program into the RAM 52 from the hard disk 55, then encodes an audio sample signal input via the interface 54 by processing it in accordance with the coding program, and outputs the coded signal via the interface 54. During decoding the CPU 51 loads the decoding program into the RAM 52 from the hard disk 55, then processes an input code under the control of the decoding program, and outputs he decoded audio sample signal. The coding/decoding programs for practicing the methods of the present invention may be program recorded on an external disk drive connected via a drive 56 to he internal bus 58. The recording medium with the programs for carrying out the coding and decoding methods of the present invention may be a magnetic recording medium, an IC memory, or any other recording medium such as a compact disk.

EFFECT OF THE INVENTION

As described above, according to the present invention, frequency-domain coefficients are sequentially divided into plural coefficient segments each consisting of plural coefficients, then the coefficient segments are each classified into one of plural groups according to the according to the intensity of the coefficient segment, and coding is performed for each group. Hence, the coefficient segments of the same group have good flatness, which allows efficient coding. With the use of the present invention, it is possible to efficiently encode a musical sound signal which has high-pitched tone components mixed in the high-frequency range, such as a metallic sound.

What is claimed:

1. An audio signal coding method for coding input audio signal samples, said method comprising the steps of:

(a) time-frequency transforming every fixed number of input audio signal samples into frequency-domain coefficients;

(b) dividing said frequency-domain coefficients into coefficient segments each consisting of one or more coefficients to generate a sequence of coefficient segments;

(c) calculating the intensity of each coefficient segment of said sequence of coefficient segments;

(d) classifying the coefficient segments in the sequence into either one of at least two groups according to the intensities of said coefficient segments to generate at least two sequences of coefficient segments, and encoding and outputting classification information as a classification information code; and (e) encoding said at least two sequences of coefficient segments and outputting them as coefficient codes.

2. The coding method of claim 1, wherein said step (d) comprises the steps of: dividing said sequence of coefficient segments into subbands each consisting of plural coefficient segments; and classifying the coefficient segments in each subband into either one of said at least two groups according to the intensities of the coefficient segments in said subband.

3. The coding method of claim 2, wherein said step (e) includes a step of encoding said at least two sequences of coefficient segments separately of each other, and outputting them as coefficient codes corresponding thereto, respectively.

4. The coding method of claim 2, wherein said step (e) comprises the steps of:

(e-1) normalizing the intensities of said at least two sequences of coefficient segments separately, encoding normalization information, and outputting the encoded normalization information as a normalization information code in said step (d);

(e-2) recombining coefficient segments of said normalized at least two sequences of coefficient segments into a single sequence of coefficient segments of the original arrangement based on said classification information; and (e-3) quantizing said recombined single sequence of coefficient segments, and outputting the quantization result as said coefficient code.

5. The coding method of claim 3 or 4, wherein: the number of said groups is two; and said step (d) is a step of: determining for each subband one threshold value in the distribution of intensities of the coefficient segments in said each subband; comparing said threshold value with the intensity of each of said coefficient segments in said each subband; and classifying said coefficient segments according to the comparison result.

6. The coding method of claim 5, wherein said step (d) includes a step of: calculating the sums of the intensities of coefficient segments belonging to said two groups for said each subband; calculating the ratio between said sums as an index of intensity variation in said each subband; and reclassifying all coefficient segments in said each subband into that one of said two groups which is lower in intensity when said ratio is lower than a predetermined value.

7. The coding method of claim 3 or 4, wherein said step (a) includes a step of: flattening said frequency-domain coefficients by pre-normalizing them with a spectral envelope of said input audio signal over the entire band thereof; and information on said spectral envelope is encoded and outputting it as a spectral envelope code.

8. The coding method of claim 4, wherein said step (e-1) is a step of: calculating a representative value of said coefficient segment intensities in said each subband of said at least two sequences of coefficient segments; and normalizing all the coefficient segments of said each subband with a value corresponding to said representative value.

9. The coding method of claim 4, wherein said step (e-1) is a step of: separately restoring said at least two sequences of coefficient segments over the entire band of said input audio signal; calculating said representative value of said each subband; normalizing said coefficient segments of said each subband with said representative value; and outputting said at least two sequences of coefficient segments as flattened sequence of coefficient segments, respectively.

10. The coding method of claim 8 or 9, wherein said step (e-1) is a step of: calculating said representative value of said coefficient segment intensities in said each subband; quantizing said representative value; normalizing said each subband with said quantized representative value; and outputting quantization information as flattening information.

11. The coding method of claim 2, wherein said step (e) comprises the steps of:

(e-1) calculating, as flattening information, a value representing intensities of coefficient segments in said each subband in said at least two sequences of coefficient segments;

(e-2) combining said flattening information of said at least two sequences of coefficient segments over the entire band of said input audio signal, and combining said at least two sequences of coefficient segments over the entire band;

(e-3) normalizing said combined coefficient segments with said combined flattening information to obtain a single flattened sequence of coefficient segments; and (e-4) encoding and outputting said single flattened sequence of coefficient segments as a coefficient code.

12. The coding method of claim 1, 3, or 4, wherein coding of said classification information in said step (d) is performed by reversible compression.

13. The coding method of claim 1, 3, or 11, wherein said step (e) is a step of coding at least one of said at least two sequences of coefficient segments by adaptive-bit-allocation quantization.

14. The coding method of claim 1, 3, or 11, wherein said step (e) is a step of scalar quantizing and then entropy coding at least one of said at least two sequences of coefficient segments.

15. The coding method of claim 1, 3, or 11, wherein said step (e) is a step of coding at least one of said at least two sequences of coefficient segments by vector quantization.

16. The coding method of claim 1, 3, or 11, wherein said step (e) is a step of coding at least one of said at least two sequences of coefficient segments by a coding method different from that of the other sequence of coefficient segments.

17. A decoding method which decodes input digital codes and outputs audio signal samples, said method comprising the steps of:

(a) decoding said input digital codes into plural sequences of coefficient segments;

(b) decoding said input digital codes to obtain classification information of coefficient segments, combining said plural sequences of coefficient segments based on said classification information to reconstruct original frequency-domain coefficients formed by a single contiguous sequence of coefficient segments; and (c) transforming said frequency-domain coefficients into audio signal samples in the time domain and outputting the audio signal samples as an audio signal.

18. A decoding method which decodes input digital codes and outputs audio signal samples, said method comprising the steps of:

(a) decoding said input digital codes into coefficient segments each consisting of plural frequency-domain coefficients;

(b) decoding said input digital codes to obtain classification information of said coefficient segments and classifying said coefficient segments into plural sequences of coefficient segments based on said classification information;

(c) decoding said input digital codes to obtain normalization information of said coefficient segments and inverse-normalizing plural sequences of coefficient segments based on said normalization information;

(d) rearranging said inverse-normalized plural sequences of coefficient segments into the original single sequence to reconstruct original frequency-domain coefficients: and (e) transforming said frequency-domain coefficients into the time domain and outputting the resulting audio signal samples as an audio signal.

19. The decoding method of claim 17, wherein said step (c) includes a step of: decoding said input digital codes to obtain a spectral envelope over the entire band of said input audio signal; and inverse-normalizing said frequency-domain coefficients with said spectral envelope.

20. The decoding method of claim 18, wherein said step (d) is a step of inverse-normalizing said reconstructed frequency-domain coefficient with said spectral envelope to use them as frequency-domain coefficients.

21. The decoding method of claim 18 or 19, wherein said step (c) is a step of restoring said classified sequence of coefficient segments over the original entire band of said input audio signal, respectively, and inverse-normalizing each subband based on said normalization information.

22. The decoding method of claim 17 or 18, wherein the decoding of said classification information in said step (b) is decoding of reversible compressed codes.

23. The decoding method of claim 17 or 19, wherein said step (a) is a step of decoding adaptive-bit-allocation-quantized codes for at least one of said plural sequences of coefficient segments.

24. The decoding method of claim 17 or 19, wherein said step (a) is a step of decoding entropy codes for at least one of said plural sequences of coefficient segments to obtain scalar-quantized coefficients.

25. The decoding method of claim 17 or 19, wherein said step (a) is a step of decoding vector-quantized codes for at least one of said plural sequences of coefficient segments.

26. The decoding method of claim 17 and 19, wherein said step (a) is a step of decoding at least one of said plural sequences of coefficient segments by a decoding method different from that for the other sequence.

27. A coding apparatus which receives input audio signal samples and outputs digital codes, said apparatus comprising:

a time-frequency transformation part for time-frequency transforming every fixed number of input audio signal samples into frequency-domain coefficients;

a coefficient segment generating part for dividing said frequency-domain coefficients from said time-frequency transformation part into segments each consisting of a contiguous sequence of coefficients;

a segmental intensity calculating part for calculating the intensity of each coefficient segment from said coefficient segment generating part;

a coefficient segment classifying part for dividing said coefficient segments into at least two groups according to the relative magnitude of said segmental intensity calculated in said segmental intensity calculating part, then classifying said segments generated in said coefficient segment generating part into at least two sequences based on information about said grouping, and encoding and outputting classification information as a digital code; and a quantization part for encoding each of said coefficients classified into said at least two sequences and outputting said encoded coefficients as said digital codes.

28. A coding apparatus which receives input audio signal samples and outputs digital codes, said apparatus comprising:

a time-frequency transformation part for time-frequency transforming every fixed number of input audio signal samples into frequency-domain coefficients;

a coefficient segment generating part for dividing said frequency-domain coefficients from said time-frequency transformation part into segments each consisting of a contiguous sequence of coefficients;

a segmental intensity calculating part for calculating the intensity of each coefficient segment from said coefficient segment generating part;

a coefficient segment classifying part for dividing said coefficient segments into at least two groups according to the relative magnitude of said segmental intensity calculated in said segmental intensity calculating part, then classifying said segments generated in said coefficient segment generating part into at least two sequences based on information about said grouping, and encoding and outputting classification information as a digital code;

a flattening part for normalizing the intensity of each of said coefficient segments classified into at least two sequences in said coefficient segment classifying part, coding normalization information, and outputting said coded information as a digital code;

a coefficient combining part for recombining said at least two intensity-normalized sequence of coefficient segments into the original single sequence of coefficient segments through utilization of said grouping information; and a quantization part for quantizing said recombined coefficient segments and outputting the quantized values as said digital codes.

29. The coding apparatus of claim 27 or 28, further comprising a second flattening part for flattening said frequency-domain coefficients from said time-frequency transformation part by normalizing them with a spectral envelope covering the entire band of said input audio signal, coding spectral envelope information, and outputting said coded information as a digital code.

30. The coding apparatus of claim 29, wherein said flattening part is means by which the coefficient segments of said classified sequences are normalized together for each group of coefficient segments close in their original frequency band.

31. A decoding apparatus which receives input digital codes and outputs audio signal samples, the apparatus comprising:

an inverse-quantization part for decoding said input digital codes into plural sequences of coefficient segments;

a coefficient combining part for decoding said input digital codes to obtain classification information of said coefficient segments, and combining said plural sequences of coefficient segments based on said classification information to reconstruct a single sequence of frequency-domain coefficients sequentially arranged; and a frequency-time transformation part for frequency-time transforming the reconstructed frequency-domain coefficients into the time domain and outputting the resulting audio signal samples as an audio signal.

32. A decoding apparatus which receives input digital codes and outputs audio signal samples, said apparatus comprising:

an inverse-quantization part for decoding said input digital codes into coefficient segments;

a coefficient segment classifying part for decoding said input digital codes to obtain classification information of said coefficient segments, and classifying said coefficient segments into plural sequences based on said classification information;

an inverse-flattening part for decoding said input digital codes to obtain normalization information of said coefficient segments classified into said plural sequences, and inverse-normalizing said plural sequences of coefficient segments based on said the normalization information;

a coefficient combining part for combining said inverse-normalized plural sequences of coefficient segments into a single sequence of coefficient segments sequentially arranged based on said classification information to reconstruct said frequency-domain coefficients; and a frequency-time transformation part for frequency-time transforming said frequency-domain coefficient into the time domain and outputting the resulting audio signal samples as an audio signal.

33. The decoding apparatus of claim 32, further comprising a second inverse-flattening part for decoding said input digital codes to obtain a spectral envelope covering the entire band of said input audio signal, and inverse-normalizing said frequency-domain coefficients to be fed to said frequency-time transformation part with said spectral.

34. The decoding apparatus of claim 32 or 33, wherein said inverse-flattening part is means by which the coefficient segments of said classified sequences are inverse-normalized together for each group of coefficient segments close in their original frequency band.

35. A recording medium having recorded thereon a coding program, said program comprising the steps of:

(a) time-frequency transforming every fixed number of input audio signal samples into frequency-domain coefficients;

(b) dividing said frequency-domain coefficients into coefficient segments each consisting of one or more coefficients to generate a sequence of coefficient segments;

(c) calculating the intensity of each coefficient segment of said sequence of coefficient segments;

(d) classifying the sequence of coefficient segments into either one of at least two groups according to the intensities of said coefficient segments to generate at least two sequences of coefficient segments, and encoding and outputting classification information as a classification information code; and (e) encoding said at least two sequences of coefficient segments and outputting them as coefficient codes.

36. The recording medium of claim 35, wherein said step (d) comprises the steps of: dividing the sequence of coefficient segments inot subbands each consisting of plural coefficient segments; and classifying the coefficient segments in each subband into either one of said at least two groups according to the intensity of the coefficient segments in said subband.

37. The recording medium of claim 36, wherein said step (e) includes a step of encoding said at least two sequences of coefficient segments separately of each other, and outputting them as coefficient codes corresponding thereto, respectively.

38. The recording medium of claim 36, wherein said step (e) comprises the steps of:

(e-1) normalizing the intensities of said at least two sequences of coefficient segments separately, encoding normalization information, and outputting the encoded normalization information as a normalization information code in said step (d);

(e-2) recombining coefficient segments of said normalized at least two sequences of coefficient segments into a single sequence of coefficient segments of the original arrangement based on said classification information; and (e-3) quantizing said recombined single sequence of coefficient segments, and outputting the quantization result as said coefficient code.

39. The recording medium of claim 37 or 38, wherein: the number of said groups is two; and said step (d) is a step of: determining for each subband one threshold value in the distribution of the coefficient segment intensity of said each subband; comparing said threshold value with said coefficient segment intensity in said each subband; and classifying said coefficient segments according to the comparison result.

40. The recording medium of claim 39, wherein said step (d) includes a step of: calculating the sums of the intensities of coefficient segments belonging to said two groups for said each subband; calculating the ratio between said sums as an index of intensity variation in said each subband; and reclassifying all coefficient segments of said each subband into that one of said two groups which is lower in intensity when said ratio is lower than a predetermined value.

41. The recording medium of claim 37 or 38, wherein said step (a) includes a step of: flattening said frequency-domain coefficients by pre-normalizing them with a spectral envelope of said input audio signal over the entire band thereof; and information on said spectral envelope is encoded and outputting it as a spectral envelope code.

42. A recording medium having recorded thereon a decoding program, said program comprising the steps of:

(a) decoding said input digital codes into plural sequences of coefficient segments;

(b) decoding said input digital codes to obtain classification information of coefficient segments, combining said plural sequences of coefficient segments based on said classification information to reconstruct original frequency-domain coefficients formed by a single contiguous sequence of coefficient segments; and (c) transforming said frequency-domain coefficients into the time domain and outputting the resulting audio signal samples as an audio signal.

43. A recording medium having recorded thereon a decoding program, said program comprising the steps of:

(a) decoding said input digital codes into coefficient segments each consisting of plural frequency-domain coefficients;

(b) decoding said input digital codes to obtain classification information of said coefficient segments and classifying said coefficient segments into plural sequences of coefficient segments based on said classification information;

(c) decoding said input digital codes to obtain normalization information of said coefficient segments and inverse-normalizing plural sequences of coefficient segments based on said normalization information;

(d) rearranging said inverse-normalized plural sequences of coefficient segments into the original single sequence to reconstruct original frequency-domain coefficients: and (e) transforming said frequency-domain coefficients into the time domain and outputting the resulting audio signal samples as an audio signal.

44. The recording medium of claim 42, wherein said step (c) includes a step of: decoding said input digital codes to obtain a spectral envelope over the entire band of said input audio signal; and inverse-normalizing said frequency-domain coefficients with said spectral envelope.

45. The recording medium of claim 43, wherein said step (d) is a step of inverse-normalizing said reconstructed frequency-domain coefficient with said spectral envelope to use them as frequency-domain coefficients.

46. The recording medium of claim 43 or 44, wherein said step (c) is a step of restoring said classified sequence of coefficient segments over the original entire bands, respectively, and inverse-normalizing each subband based on said normalization information.

* * * * *